US006324359B1

(12) United States Patent
Nakane

(10) Patent No.: US 6,324,359 B1
(45) Date of Patent: Nov. 27, 2001

(54) IMAGE FORMING APPARATUS AND TRANSFER VOLTAGE APPLYING METHOD

(75) Inventor: Eiji Nakane, Okazaki (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/507,949

(22) Filed: Feb. 22, 2000

(30) Foreign Application Priority Data

Feb. 22, 1999 (JP) ..... 11-042880

(51) Int. Cl.[7] ..... G03G 15/16

(52) U.S. Cl. ..... 399/66; 399/299; 399/314; 430/126

(58) Field of Search ..... 399/66, 299, 314, 399/302; 430/126

(56) References Cited

U.S. PATENT DOCUMENTS

| | | | | |
|---|---|---|---|---|
| 5,930,556 | * | 7/1999 | Imamiya | 399/66 |
| 5,943,526 | * | 8/1999 | Kodama | 399/66 |
| 5,974,282 | | 10/1999 | Yamada | 399/66 |
| 6,029,022 | * | 2/2000 | Takase | 399/66 |
| 6,148,159 | * | 11/2000 | Shiraishi | 399/66 X |

FOREIGN PATENT DOCUMENTS

| | | |
|---|---|---|
| 6-161304 | 6/1994 | (JP) . |
| 7-140811 | 6/1995 | (JP) . |

* cited by examiner

*Primary Examiner*—Sophia S. Chen
(74) *Attorney, Agent, or Firm*—McDermott, Will & Emery

(57) ABSTRACT

A transfer voltage applying method in an image forming apparatus for transferring toner images formed respectively on a plurality of image carriers onto an image transfer target member to be moved successively through positions where a plurality of transfer members are respectively opposed to the image carriers by applying transfer voltages to the transfer members, respectively. The transfer members are supplied with predetermined AC voltages so as that the successively neighboring at least two transfer members are supplied with the AC voltages having phases shifted from each other, respectively, and the successively neighboring at least two transfer members are not simultaneously supplied with the maximum voltages, each in absolute value, of the AC voltages. The image forming apparatus has a plurality of image carriers, a plurality of image forming devices a plurality of transfer devices each including a transfer member opposed to the corresponding image carrier and each provided for transferring to the toner image on the corresponding image carrier onto an image transfer target member, and a transfer power source. The transfer power source device supplied the AC voltages having phases shifted from each other to the successively neighboring at least two transfer members, respectively, so as that the successively neighboring at least two transfer members are not simultaneously supplied with the maximum voltages, each in absolute value, of the AC voltages.

32 Claims, 15 Drawing Sheets

Fig.15 (PriorArt)
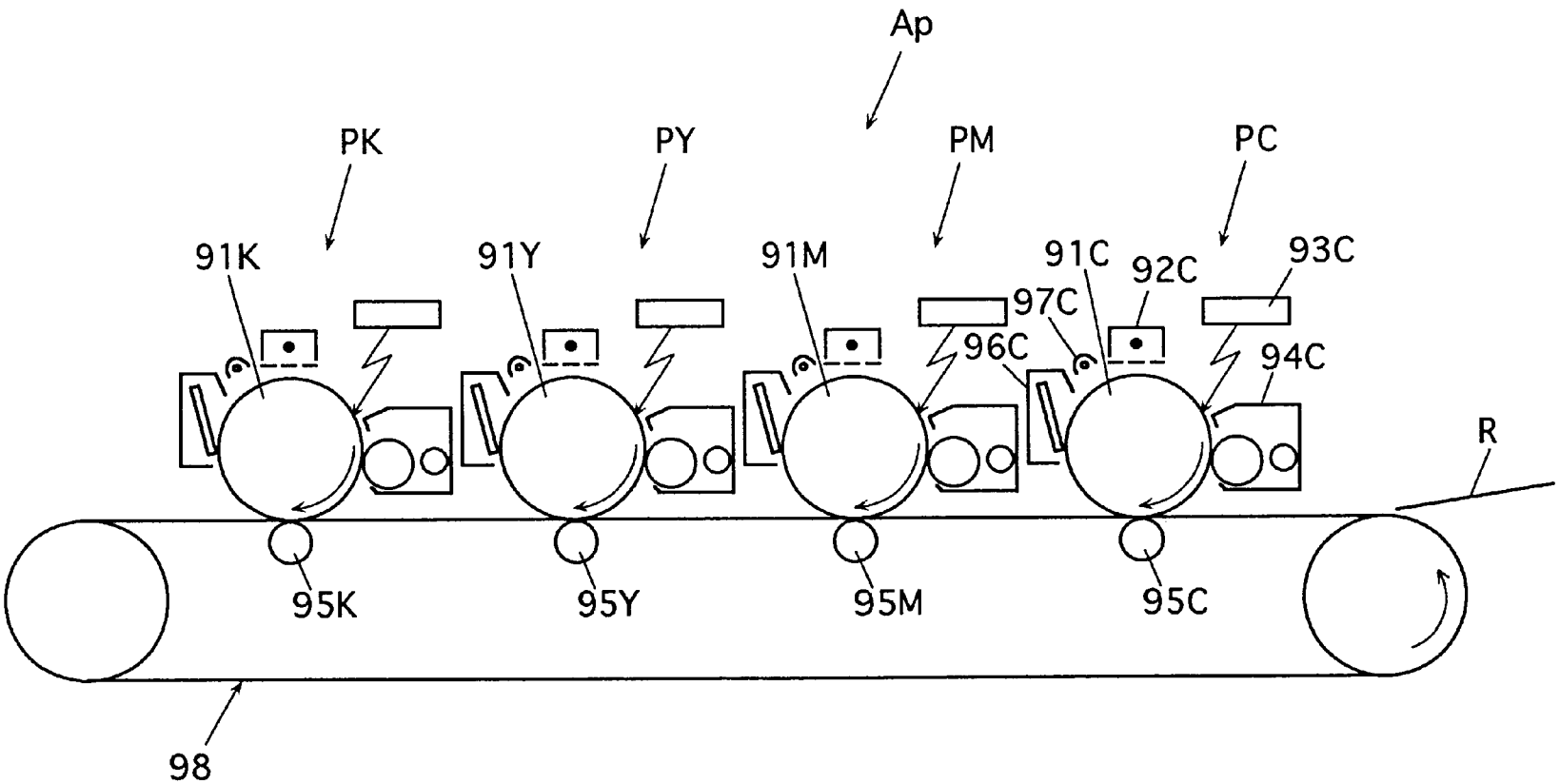

IMAGE FORMING APPARATUS AND TRANSFER VOLTAGE APPLYING METHOD

The invention is based on Japanese patent application No. H11-42880 (42880/1999) Pat. filed in Japan, the contents of which are hereby incorporated by reference.

BACKGROUND OF THE INVENTION

1. Field of the Invention

The present invention relates to a method of applying a transfer voltage to each of a plurality of transfer members, which are opposed to image carriers carrying toner images, respectively, for transferring the toner images on the image carriers onto an image transfer target member to be moved through positions between the image carriers and the transfer members.

The invention also relates to an image forming apparatus, in which a plurality of transfer members are opposed to image carriers carrying toner images, respectively, and a transfer voltage is applied to each transfer member for transferring the toner images on the image carriers onto an image transfer target member to be moved through positions between the image carriers and the transfer members.

2. Description of the Background Art

An example of a structure of a color image forming apparatus in the prior art is schematically shown in FIG. 15.

An image forming apparatus Ap shown in FIG. 15 is an electrophotographic color image forming apparatus of the tandem type.

The image forming apparatus Ap includes four image forming units PC, PM, PY and PK. The image forming units PC, PM, PY and PR can form cyan, magenta, yellow and black images of toner on a record sheet, respectively.

The image forming units PC, PM, PY and PK are disposed at respective positions opposed to an outer peripheral surface of a sheet transporting belt 98 which can carry and transport the record sheet.

The image forming unit PC has a photosensitive member 91C. Around the photosensitive member 91C, there are arranged is a charger 92C, a laser exposing device 93C, a developing device 94C containing cyan toner, a transfer roller 95C, a cleaning device 96C and an eraser lamp 97C aligned in this order.

The image forming units PM, PY and PK likewise have photosensitive members 91M, 91Y and 91K, around which devices similar to those of the image forming unit PC are successively arranged, respectively.

In the image forming apparatus Ap, a color toner image based on the original image is formed on the record sheet in the following manner.

Toner images in cyan, magenta, yellow and black are formed on the photosensitive members 91C, 91M, 91Y and 91K, respectively, and then are successively transferred onto the record sheet R transported by the sheet transporting belt 98 so that the color image is formed on the record sheet R.

The toner images formed on the photosensitive members 91C, 91M, 91Y and 91K are electrostatically transferred onto the record sheet by applying transfer voltages onto the transfer rollers 95C, 95M, 95Y and 95K, respectively. In the transferring operation, the record sheet R is transported by the sheet transporting belt 98 through a path between the photosensitive members and the transfer rollers.

The transfer roller is supplied with the transfer voltage which is, e.g., a DC voltage. It is already proposed to use, as the transfer voltage, a sinusoidal AC voltage which is superimposed on a DC voltage, and therefore has a central voltage shifted from 0 volts. It is also proposed to apply, as the transfer voltage, a pulse AC voltage superimposed on a DC voltage.

However, when the toner images formed on the respective photosensitive members are transferred onto the record sheet by applying the transfer voltages to the transfer rollers, interfere of the transfer currents flowing through the record sheet may occur in the respective transfer regions, where the transfer rollers are opposed to the photosensitive members, respectively. In particular, if the record sheet is a paper sheet which has taken up moisture, the interference of the transfer current is likely to occur. When the interference of the transfer current occurs, transfer failure such as irregular transfer occurs so that good color toner images can not be formed on the record sheet.

The transfer failure due to the interference of the transfer current occurs not only in the image forming apparatus such as an image forming apparatus Ap, which is configured to transfer the toner images formed on the respective photosensitive members directly onto the record sheet, but also in an image forming apparatus which is configured to transfer temporarily the toner images formed on the respective photosensitive members onto an intermediate transfer member, and then transfer collectively all the transferred images onto the record sheet in a secondary transfer operation.

SUMMARY OF THE INVENTION

An object of the invention is to provide a method of applying a transfer voltage in an image forming apparatus for transferring toner images respectively formed on a plurality of image carriers onto an image transfer target member to be moved successively through positions where a plurality of transfer members are respectively opposed to the image carriers by applying the transfer voltages to the respective transfer members, and particularly to provide the transfer voltage applying method in which interference of the transfer current between the transfer regions is suppressed, and good transfer can be performed in each of the transfer regions.

Another object of the invention is to provide an image forming apparatus, in which toner images respectively formed on a plurality of image carriers are transferred onto an image transfer target member to be moved successively through positions where a plurality of transfer members are respectively opposed to the image carriers by applying the transfer voltages to the respective transfer members, and particularly to provide the image forming apparatus in which interference of the transfer current between the transfer regions is suppressed, and good transfer can be performed in each of the transfer regions so that a good toner image can be formed on the record sheet.

The invention provides a transfer voltage applying method in an image forming apparatus for transferring toner images formed respectively on a plurality of image carriers onto an image transfer target member to be moved successively through positions where a plurality of transfer members are respectively opposed to the image carriers by applying transfer voltages to the transfer members, respectively, wherein the transfer members are supplied with predetermined AC voltages, respectively, so as that the successively neighboring at least two transfer members are supplied with the AC voltages having phases shifted from each other, respectively, and the successively neighboring at least two transfer members are not simultaneously supplied with the maximum voltages, each in absolute value, of the AC voltages.

The invention also provides an image forming apparatus for forming a toner image based on an original image on a record sheet, comprising:

a plurality of image carriers;

a plurality of image forming devices provided for the image carriers, respectively, and each provided for forming a toner image on the corresponding image carrier;

a plurality of transfer devices provided for the image carriers, respectively, each including a transfer member opposed to the corresponding image carrier, and each provided for transferring the toner image on the corresponding image carrier onto an image transfer target member to be moved successively through positions between the image carriers and the transfer members by applying a transfer voltage to the transfer member; and a transfer power source device for applying predetermined AC voltages as the transfer voltages to the transfer members, respectively; wherein the transfer power source device supplies the AC voltages having phases shifted from each other to the successively neighboring at least two transfer members, respectively, so as that the successively neighboring at least two transfer members are not simultaneously supplied with the maximum voltages, each in absolute value, of the AC voltages.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 15 schematically shows an example of a structure of an image forming apparatus in the prior art.

DESCRIPTION OF THE PREFERRED EMBODIMENTS

(1) Transfer Voltage Applying Method

Figure 1:
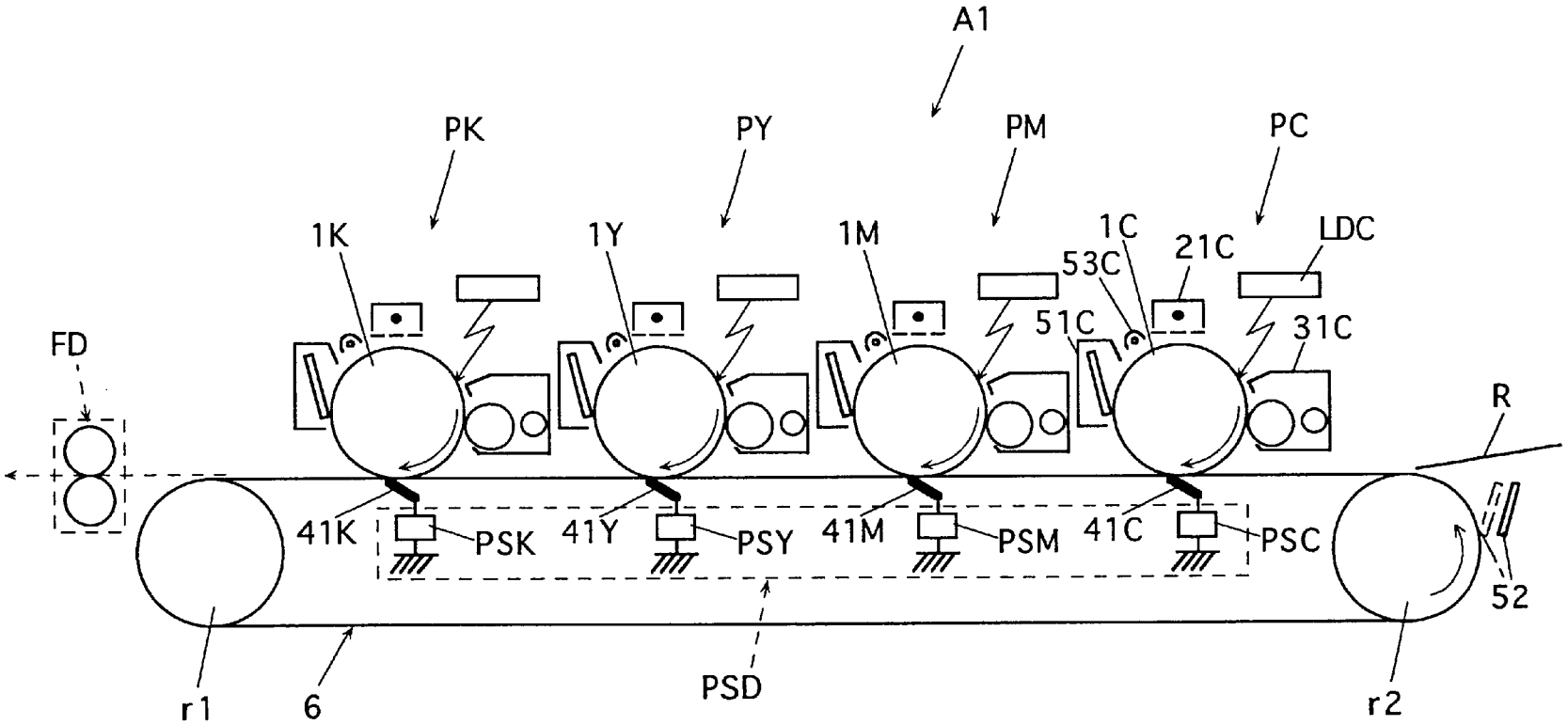
FIG. 1 schematically shows an example of an image forming apparatus according to the invention.

The invention provides, as already described, a transfer voltage applying method in an image forming apparatus for transferring toner images formed respectively on a plurality of image carriers onto an image transfer target member to be moved successively through positions where a plurality of transfer members are respectively opposed to the image carriers by applying transfer voltages to the transfer members, respectively, wherein the transfer members are supplied with predetermined AC voltages, respectively, so as that the successively neighboring at least two transfer members are supplied with the AC voltages having phases shifted from each other, respectively, and the successively neighboring at least two transfer members are not simultaneously supplied with the maximum voltages, each in absolute value, of the AC voltages.

The transfer voltage applying method according to the invention can be utilized in image forming apparatuses such as a printer, a copying machine and a facsimile.

The transfer voltage applying method according to the invention can be utilized in an image forming apparatus which has a plurality of image carriers, and in which toner images formed on respective image carriers are transferred onto a single image transfer target member (transferred image carrying member). More specifically, the transfer voltage applying method according to the invention can be utilized in the image forming apparatus which is provided with a plurality of transfer members respectively opposed to the image carriers, and in which the transfer of the toner images formed on the image carriers onto the image transfer target member is performed by applying transfer voltages to the transfer members opposed to the respective image carriers.

Any manner can be employed for forming the toner image on the image carrier. The toner image on the image carrier may be formed, e.g., by an electrophotographic method or a direct recording method.

The image carrier may be, for example, a photosensitive member. The image transfer target member may be, for example, a record sheet or an intermediate transfer member for temporarily holding the toner image to be transferred onto a record sheet.

In the transfer operation, the image transfer target member is moved successively through positions each where the transfer member is opposed to the corresponding image carrier. In the transfer operation, the image transfer target member is located between the image carrier and the transfer member. In the transfer operation, the transfer member may be a contact member which comes into contact with the image carrier through the image transfer target member, or may be a non-contact member which is spaced from the image carrier and the image transfer target member.

In either case, a predetermined transfer voltage is applied to the transfer member in the transfer operation for electrostatically transferring the toner image on the image carrier onto the image transfer target member.

In the transfer voltage applying method according to the invention, a predetermined AC voltage is applied as the transfer voltage to each transfer member.

Typically, all the transfer members may be supplied with the AC voltages of the same periods and the same waveforms. A phase relationship between the AC voltages applied to the respective transfer members will be described later.

The AC voltage is a voltage of which value is changing periodically. The AC voltage is not restricted to a sinusoidal AC voltage. For example, the AC voltage may be a sinusoidal AC voltage or a non-sinusoidal AC voltage. The non-sinusoidal AC voltage may be, e.g., an AC voltage having a triangular waveform or a pulse form. The AC voltage having the pulse form, may have, e.g., a rectangular or square pulse form, a triangular pulse form or a half-wave sinusoidal pulse form.

Each transfer member may be supplied with an AC voltage having a polarity (including 0 volts) opposite to that of the toner on the image carrier. If the toner on the image carrier has the positive polarity, the AC voltage of 0 volts or less may be applied to the transfer member. If the toner on the image carrier has the negative polarity, the AC voltage of 0 volts or more may be applied to the transfer member.

In the transfer voltage applying method according to the invention, the successively neighboring at least two transfer members are supplied with the AC voltages having phases shifted from each other, and are not supplied with the AC voltages which simultaneously take the maximum voltages in absolute values, respectively. Thus, the successively neighboring at least two transfer members are supplied with the AC voltages having shifted phases so as that the successively neighboring at least two transfer members are not simultaneously supplied with the maximum voltages, each in absolute value, of the AC voltages.

In other words, the successively neighboring at least two transfer members are supplied with the AC voltages having shifted phases, and when one of the successively neighboring at least two transfer members is supplied with the maximum voltage in absolute value of the AC voltage, each of the other transfer member(s), among the above successively neighboring at least two transfer members, is supplied with the voltage smaller in absolute value than the maximum voltage in absolute value of the AC voltage. Thus, the successively neighboring at least two transfer members are supplied with the AC voltages having shifted phases so as that, when one of the successively neighboring at least two transfer members is supplied with the maximum voltage in absolute value of the AC voltage, each of the other transfer members is supplied with the voltage smaller in absolute value than the maximum voltage in absolute value of the AC voltage.

Since the successively neighboring at least two transfer members are not simultaneously supplied with the maximum voltages, each in absolute value, of the AC voltages, the interference of transfer currents between the transfer regions can be suppressed, and therefore transfer failure such as irregular transfer can be suppressed, in compared with such a case that the successively neighboring at least two transfer members are simultaneously supplied with the maximum voltages, each in absolute value, of the AC voltages, or a case that successively neighboring at least two transfer members are supplied with the DC voltages.

It is preferable to supply the AC voltages to the transfer members to shift the phases as described below. When one of the successively neighboring at least two transfer members is supplied with the voltage, in absolute value, close to the maximum voltage in absolute value of the AC voltage, each of the other transfer members is preferably supplied with the voltage as small, in absolute value, as possible (i.e., voltage equal or close to 0 volts).

For example, the successively neighboring at least two transfer members may be supplied with the AC voltages having the shifted phases so as that the successively neighboring at least two transfer members are not simultaneously supplied with the voltages each larger, in absolute value, than 80% (preferably 50%, and more preferably 20%) of the maximum voltage in absolute value of the AC voltage. In other words, the successively neighboring at least two transfer members are supplied with the AC voltages having the shifted phases so as that, when one of the successively neighboring at least two transfer members is supplied with the voltage larger, in absolute value, than 80% of the maximum voltage in absolute value of the AC voltage, each of the other transfer members is supplied with the voltage, in absolute value, equal to or smaller than 80% of the maximum voltage in absolute value of the AC voltage.

By applying the AC voltages to the transfer members in above manner, the interference of the transfer current and therefore the transfer failure such as irregular transfer can be further suppressed. When the respective transfer members are supplied with, e.g., the pulse AC voltages of the same periods, it is easy to determine the phase relationship between the AC voltages applied to the transfer members so as to satisfy the relationship described above. As already described, the pulse AC voltage may have, e.g., a rectangular pulse form, a triangular pulse form or a half-wave sinusoidal pulse form.

In the transfer voltage applying method according to the invention, it is preferable that at least the transfer members to be simultaneously opposed to the image transfer target member are all supplied with the AC voltages having phases which are shifted as described above. All the transfer members (e.g., primary transfer members for transferring the toner images from the image carriers onto the image transfer target member) in the image forming apparatus may be supplied with the AC voltages having the phases which are shifted as described before. However, the transfer failure such as irregular transfer can be suppressed by supplying the AC voltages of the phases, which are shifted as described before, only to every neighboring two transfer members among the transfer members which are simultaneously opposed to the image transfer target member.

In the case, e.g., all the transfer members in the image forming apparatus are not simultaneously opposed to the image transfer target member, the following manners may be employed. When the image forming apparatus has two or more sets each including two transfer members neighboring to each other, the AC voltages having phases which are shifted as described above may be applied only to at least one of the sets. When the image forming apparatus has a plurality of sets each including three or more successively neighboring transfer members, the AC voltages having phases which are shifted as described above may be applied only to at least one of the sets.

More specifically, the transfer members may be supplied with the transfer AC voltages, for example, as specified in the following item (1-A) or (1-B).

(1-A) Each transfer member may be supplied with a rectangular pulse AC voltage of a predetermined period in which a voltage $V_1$ and a voltage $V_2$, which satisfy a relationship of $V_1 \cdot V_2 \geqq 0$ and a relationship of $|V_1|>|V_2|$, appear alternately. And the successively neighboring at least two transfer members may be supplied with above rectangular pulse AC voltages having phases shifted so as that the voltage $V_1$ is not supplied simultaneously to the successively neighboring at least two transfer members. In other words, the pulse AC voltages having the shifted phases may be supplied to the successively neighboring at least two transfer members so as that, when one of the successively neighboring at least two transfer members is supplied with the voltage $V_1$, each of the other transfer members is supplied with the voltage $V_2$.

The rectangular pulse AC voltage satisfying above two relationships is as follows. The rectangular pulse AC voltage satisfying the relationship of $V_1 \cdot V_2 \geqq 0$ is an AC voltage in which the polarity of the voltage $V_1$ is not opposite to that of the voltage $V_2$. In other words, when the voltage $V_1$ is positive, the voltage $v_2$ is positive or 0. When the voltage $V_1$ is negative, the voltage $V_2$ is negative or 0. Since the relationship of $|V_1|>|V_2|$ is also satisfied, the maximum voltage in absolute value of above rectangular pulse AC voltage is $|V_1|$.

By supplying above rectangular pulse AC voltages having phases shifted so as not to apply the voltage $V_1$ simultaneously to the successively neighboring at least two transfer members, it is possible to suppress interference of the transfer current via the image transfer target member between the neighboring two transfer regions, and thereby the toner images on the image carriers opposed to the respective transfer members can be sufficiently transferred onto the image transfer target member without transfer irregularities.

The voltage $V_2$ may have the absolute value $|V_2|$ which is equal to or smaller than 80% (preferably 50%, and more preferably 20%) of the absolute value $|V_1|$ of the voltage $V_1$, whereby the interference of the transfer currents between the neighboring two transfer regions can be suppressed, and good transfer of the toner image can be performed in each transfer region. The voltage $V_2$ may be 0 volts, in which case the interference of the transfer currents between the neighboring two transfer regions hardly occurs so that further good transfer can be performed.

The successively neighboring at least two transfer members are required not to be supplied with the voltage $V_1$ simultaneously, and therefore may be simultaneously supplied with the voltage $V_2$.

A duty ratio of the rectangular pulse AC voltages applied to the respective transfer members may be determined, e.g., depending on the number of the transfer members.

(1-B) Each transfer member may be supplied with a sinusoidal AC voltage which has a predetermined period and has a central voltage shifted from 0 volts by ½ or more of the peak-to-peak voltage. And the neighboring two transfer members may be supplied with the above sinusoidal AC voltages having the phases shifted by 180° from each other. Every neighboring two transfer members may be supplied with the above sinusoidal AC voltages having the phases shifted by 180° from each other.

The sinusoidal AC voltage, of which central voltage is shifted from 0 V by ½ or more of the peak-to-peak voltage, is, in other words, an AC voltage formed by superimposing a component sinusoidal AC voltage having a central voltage of 0 volts with a DC voltage of ½ or more of the peak-to-peak voltage of the component sinusoidal AC voltage.

By applying above sinusoidal AC voltages, which have phases shifted by 180° from each other, to the neighboring two transfer members as described above, when one of the neighboring two transfer members is supplied with the voltage close, in absolute value, to the maximum voltage, the other transfer member is supplied with the voltage close, in absolute value, to the minimum voltage. Thereby, interference of the transfer currents between the neighboring two transfer regions can be suppressed. Accordingly, good transfer can be performed in the neighboring two transfer regions.

By setting the minimum voltage in absolute value of the above sinusoidal AC voltage applied to each transfer member to 0 volts, such a situation does not occur that the voltages each larger, in absolute value, than 50% of the maximum voltage in absolute value are simultaneously applied to the neighboring two transfer members. And when one of the neighboring two transfer members is supplied with the voltage close, in absolute value, to the maximum voltage, the other transfer member is supplied with the voltage close, in absolute value, to 0 volts. Owing to these, transfer failure such as irregular transfer can be further suppressed by employing the sinusoidal AC voltages having the minimum voltage in absolute value equal to 0 volts.

In the transfer voltage applying method according to the invention described above, the AC voltages applied to the respective transfer members may have the following periods.

For example, the period of the AC voltage applied to each transfer member may be smaller than or equal to a time required for moving one arbitrary point on the image transfer target member through the transfer region where the transfer member is opposed to the image carrier. Thereby, the appropriate voltage which is enough to and necessary for transfer of the toner image onto the image transfer target member can be applied at least one time to the transfer member while one arbitrary point on the image transfer target member passes through the transfer region. Thereby, irregular transfer, e.g., due to insufficient application of the transfer voltage can be prevented.

In the case where the transfer member is in contact with the image carrier, or where the transfer member is in contact with the image carrier via the image transfer target member, the transfer region may be, e.g., a nip portion between the transfer member and the image carrier, or between the transfer member and the image transfer target member. In this case, the period T (sec) of the AC voltage applied to the transfer member may be determined to satisfy the relationship of $T \leqq W/V$. W (mm) is a width of the nip portion between the transfer member and the image carrier, or a width of the nip portion between the transfer member and the image transfer target member. V (mm/sec) is a surface moving speed of the image transfer target member during movement through a position is between the transfer member and the image carrier in the transferring operation. W/V can be deemed as the time required for passing one point on the image transfer target member through the nip portion, and in other words, the time required for passing the one point on the image transfer target member through the transfer region. Accordingly, by employing the relationship of $T \leqq W/V$, the voltage of the appropriate magnitude necessary for transferring the toner image onto the image transfer target member can be applied at least one time to the transfer member while the arbitrary one point on the image transfer target member passes through the nip portion.

(2) Image Forming Apparatus

The invention provides, as already described, an image forming apparatus for forming a toner image based on an original image on a record sheet, comprising: a plurality of image carriers; a plurality of image forming devices provided for the image carriers, respectively, and each provided for forming a toner image on the corresponding image carrier; a plurality of transfer devices provided for the image carriers, respectively, each including a transfer member opposed to the corresponding image carrier, and each provided for transferring the toner image on the corresponding image carrier onto an image transfer target member to be moved successively through positions between the image carriers and the transfer members by applying a transfer voltage to the transfer member; and a transfer power source device for applying predetermined AC voltages as the transfer voltages to the transfer members, respectively; wherein the transfer power source device supplies the AC voltages having phases shifted from each other to the successively neighboring at least two transfer members, respectively, so as that the successively neighboring at least two transfer members are not simultaneously supplied with the maximum voltages, each in absolute value, of the AC voltages.

The image forming apparatus according to the invention is an apparatus which can perform the transfer voltage applying method according to the invention described above.

The contents of the foregoing item (1) relating to the transfer voltage applying method are true also with respect to the image forming apparatus according to the invention.

The image forming apparatus according to the invention can be utilized, e.g., as a printer, a copying machine or a facsimile.

The image forming apparatus according to the invention includes a plurality of image carriers, a plurality of image forming devices and a plurality of transfer devices. The image carriers, image forming devices and transfer devices are equal in number to each other. Each transfer device has a transfer member. The plurality of image forming devices are provided for the plurality of image carriers, respectively. The plurality of transfer devices are provided for the plurality of image carriers, respectively. Thus, the image forming is apparatus according to the invention includes a plurality of image forming units each including the image carrier, the image forming device and the transfer device.

A toner image can be formed onto the image carrier by the image forming device provided for this image carrier. The toner image formed on the image carrier can be transferred onto the image transfer target member by the transfer device provided for this image carrier. By applying a voltage to the transfer member of the transfer device, the toner image on the image carrier is transferred onto the image transfer target member. In the transfer operation, the image transfer target member is moved through a position between the image carrier and the transfer member.

The manner of forming the toner image onto the image carrier by the image forming device may be any manner. The image forming device may be, e.g., an electrophotographic image forming device which can form the toner image onto the image carrier in an electrophotographic method. In the case here the image forming device of the electrophotographic type is employed, the image carrier may be, for example, a photosensitive member. The image forming device may be of a direct recording type, in which the toner image is formed directly onto the image carrier without forming an electrostatic latent image onto the image carrier. The image forming devices of the direct recording type are taught, e.g., in Japanese Laid-Open Patent Publication Nos. S60-192652, S61-286164 and S62-248662 as well as in Japanese Patent Publication No. 2687506.

The transfer member of the transfer device may have a known structure. The transfer member may be, e.g., a brush, a roller, a blade or a sheet. The transfer member such as a brush, a roller, a blade or a sheet may be brought into contact with the image carrier via the image transfer target member in the transfer operation. The transfer device may be a discharging charger such as a Corotron charger or a Scorotron charger, and the transfer member may include a discharging electrode for performing discharging to the image transfer target member which is disposed between the transfer member and the image carrier in the transfer operation.

The image transfer target member may be, e.g., a record sheet. In the case where the image transfer target member is the record sheet, the image forming apparatus may be provided with a sheet transporting device for transporting the record sheet successively to the positions opposed to the respective image carriers. The sheet transporting device may transport the record sheet through a position between the image carrier and the transfer member of the transfer device provided for this image carrier. For example, the sheet transporting device may have a sheet transporting rotary member having an outer peripheral surface opposed to all the image carriers. The sheet transporting rotary member may be, for example, an endless belt retained around two or more rollers. The record sheet can be transported successively to the positions opposed to the respective image carriers by holding, with e.g., an electrostatic attraction force, the record sheet on the outer peripheral surface of the sheet transporting rotary member, and by rotating the sheet transporting rotary member.

The image transfer target member may be an intermediate transfer member for temporarily holding the toner image to be transferred onto the record sheet. The intermediate transfer member may have a rotary form such as an endless belt. A plurality of toner images transferred from the respective image carriers onto the intermediate transfer member are transferred onto the record sheet to form the toner image on the record sheet. In a typical manner, the toner images on the respective image carriers may be successively transferred onto the intermediate transfer member, and are superimposed onto the toner image(s) already transferred on the intermediate transfer member.

In the image forming apparatus according to the invention, the plurality of image forming devices may be configured to form the toner images with toner of different colors (e.g., cyan, magenta, yellow and black), whereby the color toner image can be formed on the record sheet.

The image forming apparatus according to the invention further includes a transfer power source device in addition to the plurality of image carriers, the plurality of image forming devices and the plurality of transfer devices.

The transfer power source device can apply predetermined AC voltages as the transfer voltages to the transfer members of the respective transfer devices.

The transfer power source device may include, e.g., a plurality of power sources provided for the respective transfer members. The transfer power source device may include the power source which is common to two or more transfer members among the plurality of transfer members. The AC voltage which is applied to the transfer member by the transfer power source device in the transfer operation may be, e.g., a sinusoidal AC voltage or a non-sinusoidal AC voltage as already described in the foregoing item (1). The respective transfer members are typically supplied with the AC voltages of the same periods and the same waveforms.

The transfer power source device applies to the respective transfer members the AC voltages in the manner which is already described in the item (1) relating to the transfer voltage applying method. Accordingly, in the image forming apparatus according to the invention, it is possible to suppress interference of the transfer current between the transfer regions, and thereby good transfer can be performed in each transfer region. Accordingly, good toner images without transfer irregularities can be formed on the record sheet.

When the image transfer target member is the record sheet, and also when the image forming apparatus is provided with the sheet transporting device including the sheet transporting rotary member for transporting the record sheet as described above, the image forming apparatus may be further provided with an attracting device and a power source for attraction having the following structures.

The attraction device is provided for attracting the record sheet onto the outer peripheral surface of the sheet transporting rotary member. The attraction device may include an attracting member opposed to the sheet transporting rotary member, and the attraction of the record sheet, which is to be moved through a position between the attracting member and the sheet transporting rotary member, may be performed by applying a voltage for attraction to the attracting member. The attraction power source may be provided for applying a predetermined AC voltage for attraction to the attracting member. The attracting member may be the same as that already described as the transfer member. The transfer power source device for applying the AC voltages to the respective transfer members may also serve as the power source for attraction.

Similarly to the operation of applying the transfer voltages to successively neighboring at least two transfer members, the transfer power source device may apply the AC voltages for transfer to the transfer members such that the transfer member neighboring to the attracting member is not supplied with the maximum voltage in absolute value of the transfer AC voltage (AC voltage as the transfer voltage) when the attracting member is supplied with the maximum voltage in absolute value of the attraction AC voltage from the attraction power source. The AC voltages for attraction and transfer may be the AC voltages, e.g., of the same periods and the same waveforms. Such a manner may be employed that, when the attraction power source applies to the attracting member the voltage larger, in absolute value, than 80% of the maximum voltage in absolute value of the attraction AC voltage, the transfer power source device does not apply the voltage larger, in absolute value, than 80% of the maximum voltage in absolute value of the transfer AC voltage to the transfer member neighboring to the attracting member.

By applying the AC voltages to the attracting member and the transfer member neighboring thereto in the manner described above, it is possible to suppress the interference of the attraction current and the transfer current in the transfer region neighboring to the attraction member, and therefore the transfer failure can be suppressed, similarly to the manner of suppressing the interference of the transfer currents between the neighboring two transfer regions, and therefore suppressing the transfer failure.

In the case where the image transfer target member is the record sheet, and the image forming apparatus is provided with the sheet transporting device including the sheet transporting rotary member for transporting the record sheet as described above, the image forming apparatus may be further provided with a separating device and a power source for separation having the following structures.

The separating device is provided for separating the record sheet from the sheet transporting rotary member, or for allowing easy separation of the record sheet from the sheet transporting rotary member. The separating device may include a separating member opposed to the sheet transporting rotary member, and the separation of the record sheet may be performed by applying a separation voltage to the separating member. The separation power source may be provided for applying a predetermined AC voltage as the separation voltage to the separating member. The separating member may be the same as that already described as the transfer member. The transfer power source device for applying the AC voltages to the respective transfer member may also serve as the separation power source.

Similarly to the case where the transfer voltages are applied to the successively neighboring at least two transfer members, the transfer power source device may apply the transfer AC voltages to the transfer members such that the transfer member neighboring to the separating member is not supplied with the maximum voltage in absolute value of the transfer AC voltage when the separating member is supplied with the maximum voltage in absolute value of the separation AC voltage from the separation power source. For example, the separation AC voltage and the transfer AC voltage may have the same periods and the same waveforms. Such a manner may be employed that, when the separation power source applies to the separating member the voltage larger, in absolute value, than 80% of the maximum voltage in absolute value of the separation AC voltage, the transfer power source device does not apply to the transfer member neighboring to the separating member the voltage larger, in absolute value, than 80% of the maximum voltage in absolute value of the transfer AC voltage.

By applying the AC voltages to the separating member and the transfer member neighboring thereto in the above manner, transfer failure in the transfer region neighboring to the separating member due to interference of the separation current can be suppressed.

If the image transfer target member is the intermediate transfer member for temporarily carrying the toner image to be transferred onto the record sheet as already described above, the image forming apparatus may be further provided with a secondary transfer device and a secondary transfer power source having the following structures.

The secondary transfer device is provided for transferring the toner image, which has been already transferred onto the intermediate transfer member in the primary transfer step, from the intermediate transfer member onto the record sheet. The secondary transfer device may include a secondary transfer member opposed to the intermediate transfer member, and the secondary transfer of the image onto the record sheet, which is to be moved through a position between the intermediate transfer member and the secondary transfer member, may be performed by applying a secondary transfer voltage to the secondary transfer member. The secondary transfer power source may be provided for applying a predetermined AC voltage as the secondary transfer voltage to the secondary transfer member. The secondary transfer member may be the same as that already described as the transfer member (i.e., the primary transfer member for transferring the toner image from the image carrier onto the image transfer target member). The transfer power source device for applying the AC voltages to the respective primary transfer members may also serve as the secondary transfer power source.

Similarly to the case where the transfer voltages are applied to the successively neighboring at least two transfer members, the transfer power source device may apply the primary transfer AC voltages to the primary transfer members in such a manner that the primary transfer member neighboring to the secondary transfer member is not supplied with the maximum voltage in absolute value of the primary transfer AC voltage when the secondary transfer power source applies to the secondary transfer member the maximum voltage in absolute value of the secondary transfer AC voltage. The secondary transfer AC voltage and the primary transfer AC voltage may have the same periods and the same waveforms. Such a manner may be employed that, when the secondary transfer power source applies to the secondary transfer member the voltage larger, in absolute value, than 80% of the maximum voltage in absolute value of the secondary transfer AC voltage, the transfer power source device does not apply to the primary transfer member neighboring to the secondary transfer member the voltage larger, in absolute value, than 80% of the maximum voltage in absolute value of the primary transfer AC voltage.

By applying the AC voltages to the secondary transfer member and the primary transfer member neighboring thereto in the above manner, it is possible to suppress primary transfer failure due to interference of the secondary transfer current in the primary transfer region neighboring to the secondary transfer member. Further, secondary transfer failure in the secondary transfer region due to interference of the primary transfer current can be also suppressed.

(3) Embodiments of the invention will now be described with reference to the drawings.

FIG. 1 schematically shows an example of a structure of an image forming apparatus according to the invention.

An image forming apparatus A1 shown in FIG. 1 is a color image forming apparatus of an electrophotographic tandem type as will be described below. The image forming apparatus A1 is an apparatus for forming a toner image based on an original image on a record sheet.

The image forming apparatus A1 includes four image forming units PC, PM, PY and PK for forming cyan, magenta, yellow and black images, respectively.

The four image forming units PC, PM, PY and PK are disposed in the positions opposed to an outer peripheral surface of a sheet transporting belt 6 for carrying and transporting the record sheet R.

The cyan image forming unit PC has a photosensitive member 1C of a drum form. The photosensitive member 1C is electrically grounded. A charger 21C, a laser device LDC, a developing device 31C accommodating cyan toner, a transfer brush 41C, a cleaning device 51C and an eraser lamp 53C are arranged in this order around the photosensitive member 1C. The transfer brush 41C is a transfer member which is supplied with a transfer voltage for transferring the toner image formed on the photosensitive member 1C onto the record sheet. The transfer brush 41C is arranged at the inner peripheral side of the sheet transporting belt 6, and is opposed to the photosensitive member 1C. The transfer brush 41C is in contact with the photosensitive member 1C with the sheet transporting belt 6 therebetween.

The magenta, yellow and black image forming units PM, PY and PK have photosensitive members 1M, 1Y and 1K, respectively. Devices similar to those arranged around the photosensitive member 1C of the cyan image forming unit PC are arranged around each of the photosensitive members of the magenta, yellow and black image forming units PM, PY and PK. Each of the photosensitive members 1M, 1Y and 1K is grounded.

The photosensitive members 1M, 1Y and 1K are opposed to transfer brushes 41M, 41Y and 41K, respectively. The transfer brushes 41M, 41Y and 41K are in contact with photosensitive members 1M, 1Y and 1K via the sheet transporting belt 6, respectively.

Figure 2:
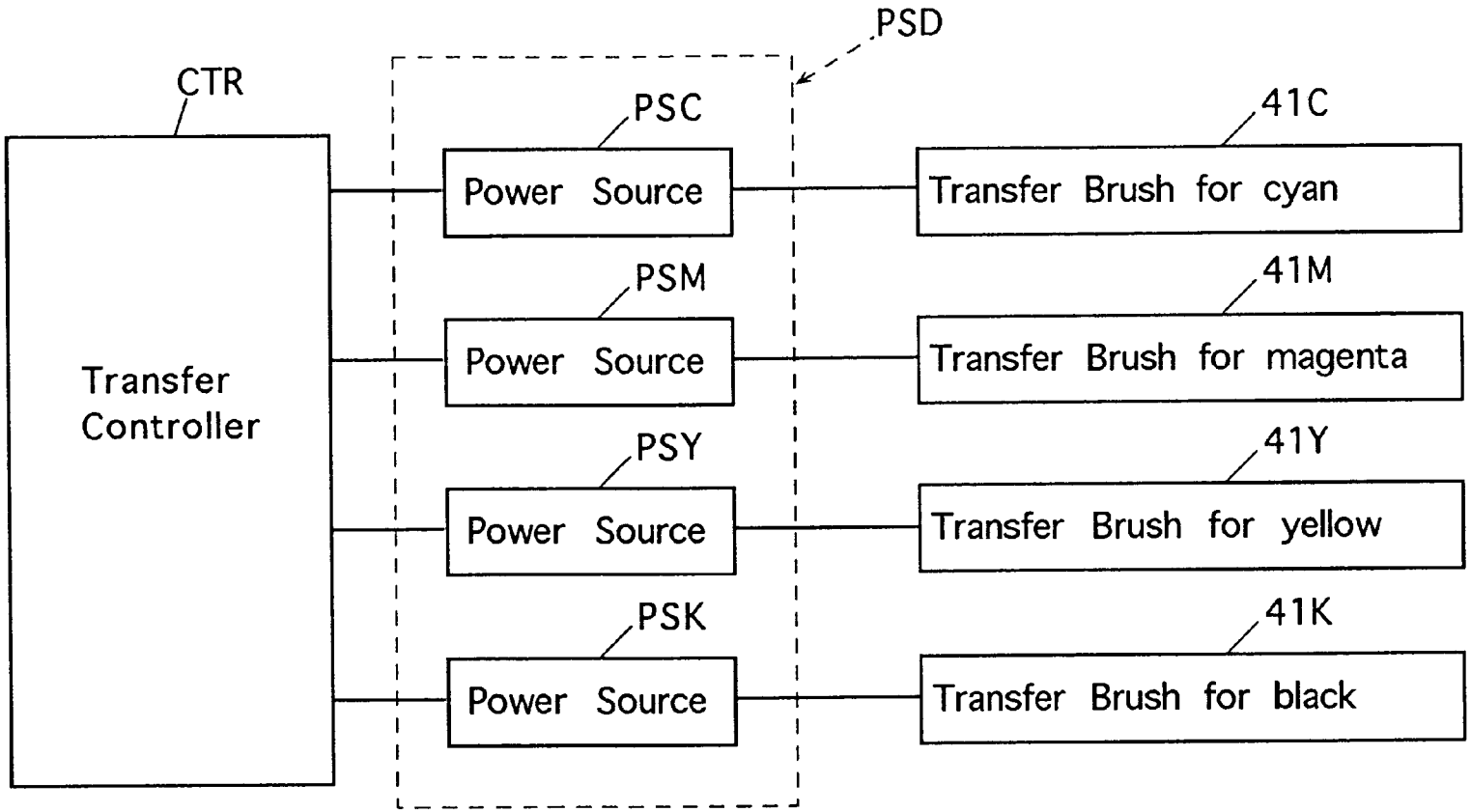
FIG. 2 a schematic block diagram of devices related to transfer of toner images in the image forming apparatus shown in FIG. 1.

The transfer brushes 41C, 41M, 41Y and 41K of the image forming units are connected to a transfer power source device PSD for applying the transfer voltages to these transfer brushes. The transfer power source device PSD has power sources PSC, PSM, PSY and PSK connected to transfer brushes 41C, 41M, 41Y and 41K, respectively. The transfer power source device PSD is connected to a transfer controller CTR as shown in FIG. 2. The transfer controller CTR controls application of the transfer voltage from each power source to the corresponding transfer brush.

The sheet transporting belt 6 is an endless belt retained around two rollers r1 and r2. A cleaning blade 52 is disposed at the outer side of the sheet transporting belt 6, and is opposed to the roller r2. The cleaning blade 52 can be moved between the position where it is in contact with the sheet transporting belt 6 and the position spaced from the sheet transporting belt 6. Only when an operation of removing the toner from the sheet transporting belt 6 is necessary, the cleaning blade 52 is located in the position where it comes into contact with the sheet transporting belt 6.

The sheet transporting belt 6 can attract the record sheet R onto its outer peripheral surface for carrying it. The roller r2 is driven to rotate counterclockwise in FIG. 1 by a drive device (not shown) so that the record sheet carried on the outer peripheral surface of the sheet transporting belt 6 can be successively transported through the positions opposed to the photosensitive members of the respective image forming units PC, PM, PY and PK.

The image forming units PC, PM, PY and PK can form a color toner image based on the original image on the record sheet in the following manner. The toner images of the original images of cyan, magenta, yellow and black color components are superimposed on the record sheet so that the color toner image based on the original image is formed on the record sheet.

Description will be given on the manner of forming the cyan toner image on the record sheet by the cyan image forming unit PC.

In the image forming operation, the photosensitive member 1C is driven to rotate clockwise in FIG. 1, and the sheet transporting belt 6 is driven counterclockwise in FIG. 1. The photosensitive member IC is driven to move its outer peripheral surface at a predetermined peripheral surface speed V (mm/sec). The photosensitive members of the other image forming units are also driven to rotate at the same peripheral surface speed V. The sheet transporting belt 6 is also driven to rotate at the same peripheral surface speed V (mm/sec) as the photosensitive member.

In the image forming operation, in the first step, the photosensitive member IC is irradiated with light emitted from the eraser lamp 53C for erasing the charges. Then, the photosensitive member 1C is charged by the charger 21C. By exposing the charged photosensitive member 1C with the laser device LDC, an electrostatic latent image of the original image of the cyan component is formed on the photosensitive member 1C. The cyan original image data is supplied from a host device (not shown). The electrostatic latent image is developed with cyan toner by the developing device 31C so that the cyan toner image is formed on the photosensitive member 1C. The developing device 31C in this embodiment uses the negatively charged cyan toner for development. The developing devices of the other image forming units likewise use the negatively charged toner for development. The cyan toner image on the photosensitive member 1C is transferred by the transfer brush 41C onto the record sheet R carried on the sheet transporting belt 6. By applying the transfer voltage to the transfer brush 41C from the power source PSC, the cyan color toner image on the photosensitive member 1C is electrostatically transferred onto the record sheet. The manner of applying the transfer voltage to the transfer brush 41C will be described later in detail.

In a similar manner, the magenta, yellow and black toner images are formed on the photosensitive members in the image forming units PM, PY and PK, respectively. These toner images are successively transferred onto the record sheet carried on the sheet transporting belt 6, and each is superimposed on the toner image already transferred. The record sheet carrying the transferred multiple images is separated from the sheet transporting belt 6, and the color toner image is fixed by the fixing device FD. Then, the sheet is discharged from the apparatus.

In the image forming apparatus A1 of the invention, the transfer brushes 41C, 41M, 41Y and 41K are supplied with the transfer voltages in the following manner.

Figure 3:
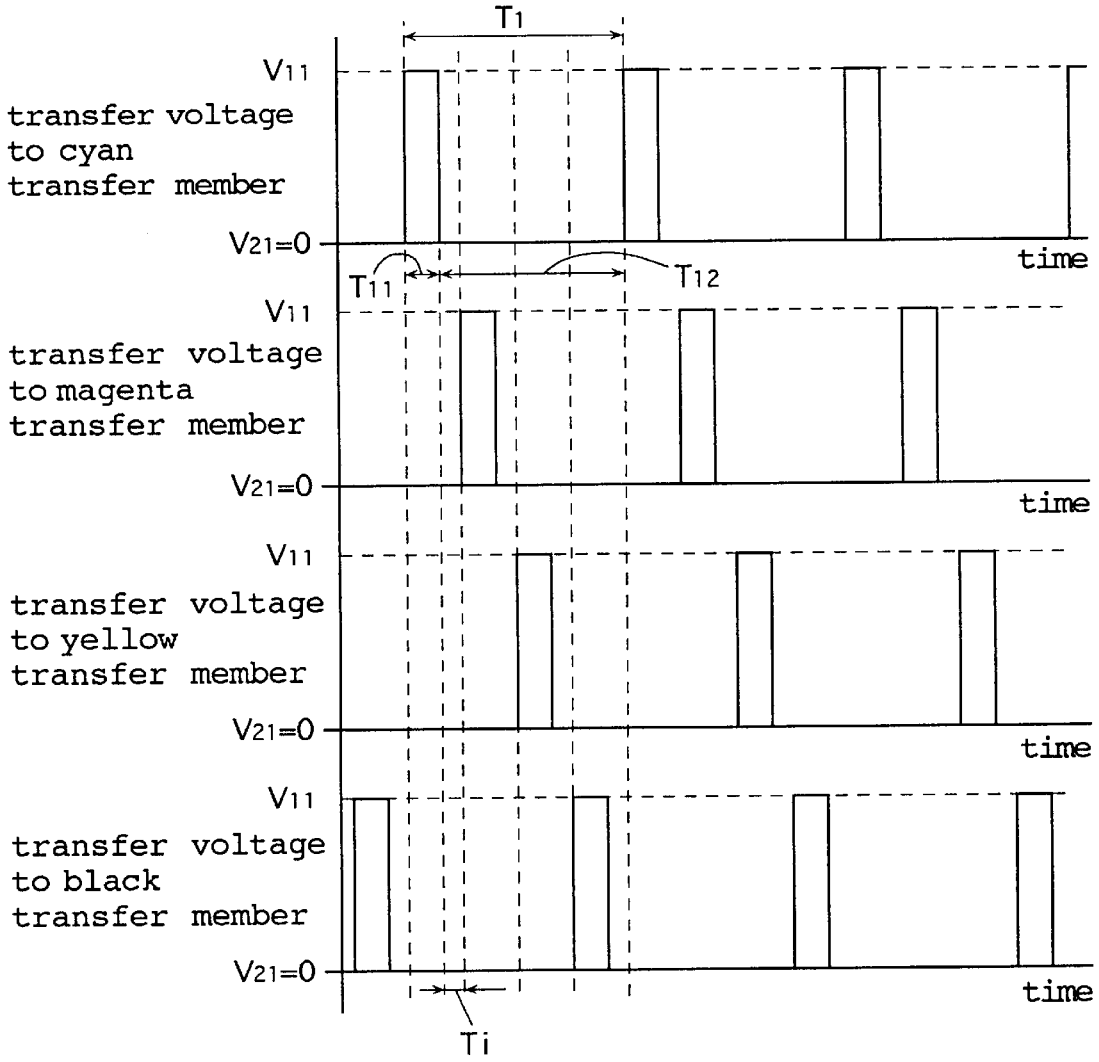
FIG. 3 shows an example of waveforms of AC voltages applied to respective transfer members of the image forming apparatus shown in FIG. 1 as well as phase relationships between them.

FIG. 3 shows the waveforms and phases of the transfer voltages applied to the respective transfer brushes in the transfer operation.

The transfer brushes 41C, 41M, 41Y and 41K are supplied with the AC voltages of the same periods and the same waveforms from the power sources PSC, PSM, PSY and PSK, respectively. In this embodiment, each transfer brush is supplied with the AC voltage of a rectangular pulse form, .i.e., rectangular pulse AC voltage.

The rectangular pulse AC voltage applied to the transfer brush is an AC voltage, in which a voltage $V_{11}$, and a voltage $V_{21}$, alternately appear. The voltage $V_{11}$, in this embodiment is +1.5 kilovolts. The polarity of the voltage $V_{11}$ is opposite to the polarity (negative polarity in this embodiment) of the toner on the photosensitive member. The voltage $V_{11}$ has an appropriate magnitude necessary for transferring the toner image on the photosensitive member onto the record sheet. The voltage $V_{21}$ in this embodiment is 0 volts. The rectangular pulse AC voltage has a period $T_1$ (sec). The duty ratio of the rectangular pulse AC voltage in this embodiment is 16%. Assuming that the voltages $V_{11}$ and $V_{21}$ are applied to the transfer brushes for times of $T_{11}$ and $T_{12}$, respectively, the duty ratio is equal to $[\{T_{11}/(T_{11}+T_{12})\}\times 100\ (\%)]$.

The transfer controller CTR applies to the transfer brushes 41C, 41M, 41Y and 41K the foregoing rectangular pulse AC voltages having phases successively shifted by 90°, respectively.

Thereby, the two or more transfer brushes are not simultaneously supplied with the voltage $V_{11}$. In other words, when one of the transfer brushed 41C, 41<, 41Y and 41K, i.e., successively neighboring four transfer brushes, is supplied with the voltage $V_{11}$, the other transfer brushes are supplied with the voltage $V_{21}$ (0 volts in this embodiment). Thus, when one of the successively neighboring four transfer brushes is supplied with the voltage $V_{11}$, the other transfer brushes are not supplied with the voltage. An interval time Ti, during which neither of the two neighboring transfer brushes is supplied with the voltage, is present after application of the voltage $V_{11}$ to one of these transfer brushes and before application of the voltage $V_{11}$ to the other transfer brush.

According to the image forming apparatus A1 of the invention, the voltage $V_{11}$ of the appropriate magnitude necessary for transferring the toner image is not simultaneously applied to the two or more transfer brushes.

Therefore, interference of the transfer current does not occur in each transfer region, where the transfer brush is opposed to the photosensitive member, even at a high atmospheric humidity, and therefore transfer failure such as irregular transfer can be prevented.

The period $T_1$ of the rectangular pulse AC voltage applied to each transfer brush is set as follows for preventing irregular transfer, e.g., due to insufficient application of the transfer voltage. The period $T_1$ of the AC voltage applied to each transfer brush is set to satisfy the relationship of $[T_1 \leqq (\text{nip width W})/(\text{speed V})]$. The speed V (mm/sec) represents the moving speed of the peripheral surface of each of the photosensitive member and the sheet transporting belt in the image forming operation, as already described. The speed V is the moving speed of the record sheet carried on the sheet transporting belt when the record sheet moves through a position between the photosensitive member and the transfer brush. The nip width W (mm) is a width of the nip portion in the record sheet moving direction, where the transfer brush is in contact with the photosensitive member through the sheet transporting belt 6. The time which is required for moving one arbitrary point on the record sheet through the nip portion is equal to {(nip width W)/(speed V)}. Accordingly, by applying the AC voltage of the period $T_1$ satisfying the above relationship to the transfer brush, the voltage $V_{11}$ is applied at least one time to the transfer brush while the arbitrary one point on the record sheet is moving through the nip portion between the photosensitive member and the transfer brush. Further, the voltage $V_{11}$ is applied to the transfer brush for at least the time $T_{11}$ while the arbitrary one point on the record sheet is moving through the nip portion. Accordingly, irregular transfer due to insufficient application of the transfer voltage can be prevented even if the pulse voltage is intermittently applied to each transfer brush.

Owing to the above features, the image forming apparatus A1 of the invention can perform good transfer of the toner images in the respective colors onto the record sheet, and can form the good color toner image on the record sheet.

Figure 4:
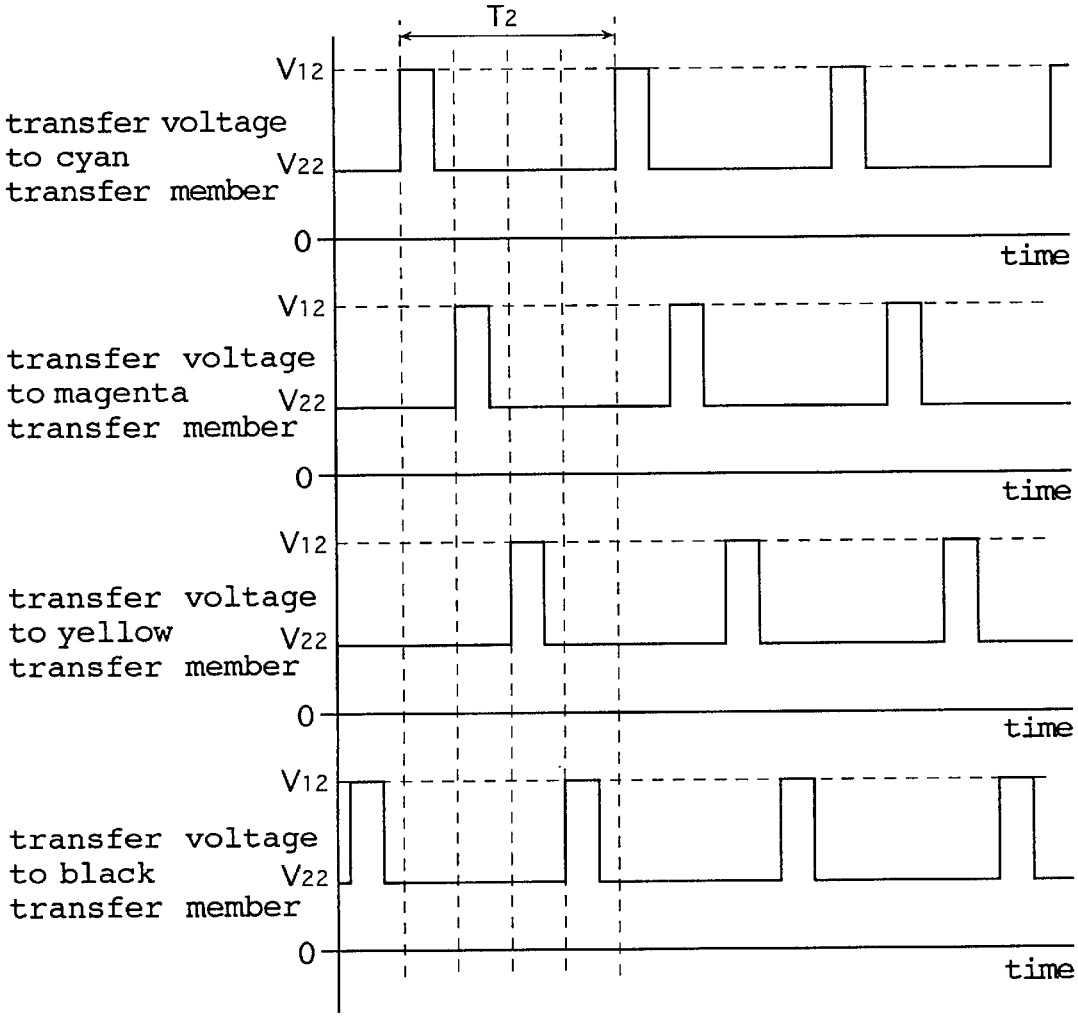
FIG. 4 shows, as another example, the waveforms of AC voltages applied to respective transfer members of the image forming apparatus shown in FIG. 1 as well as the phase relationships between them.

(4) In view of a rising time of the voltage applied to the transfer brush, each transfer brush may be supplied with a rectangular pulse AC voltage shown in FIG. 4 instead of the rectangular pulse AC voltage shown in FIG. 3, in which case it is likewise possible to suppress the transfer failure such as irregular transfer due to interference of the transfer current.

The rectangular pulse AC voltage shown in FIG. 4 has a period of $T_2$, and in which voltages $V_{12}$ and $V_{22}$ alternately appear. The voltage $V_{12}$ in this embodiment is equal to +1.5 kilovolts. The voltage $V_{12}$ has an appropriate magnitude necessary for transferring the toner image on the photosensitive member onto the record sheet. The voltage $V_{22}$ in this embodiment is equal to 80% of the voltage $V_{12}$, and therefore is equal to +1.2 kilovolts. The successively neighboring four transfer brushes are supplied with the foregoing rectangular pulse AC voltages having phases successively shifted by 90°.

Thereby, the two or more transfer brushes are not simultaneously supplied with the voltage $V_{12}$ (i.e., the larger voltage in absolute value between the voltages $V_{12}$ and $V_{22}$). When one of the four transfer brushes is supplied with the voltage $V_{12}$, the other transfer brushes are supplied with the voltage $V_{22}$. Since the voltage $V_{22}$ is 80% of the voltage $V_{12}$, the interference of the transfer current between the transfer regions can be suppressed in contrast to the prior art in which all the transfer brushes are supplied with a DC voltage of $V_{12}$. As a result, the transfer failure such as irregular transfer can be suppressed more effectively than the prior art, and the good transfer of the toner image can be performed.

Figure 5:
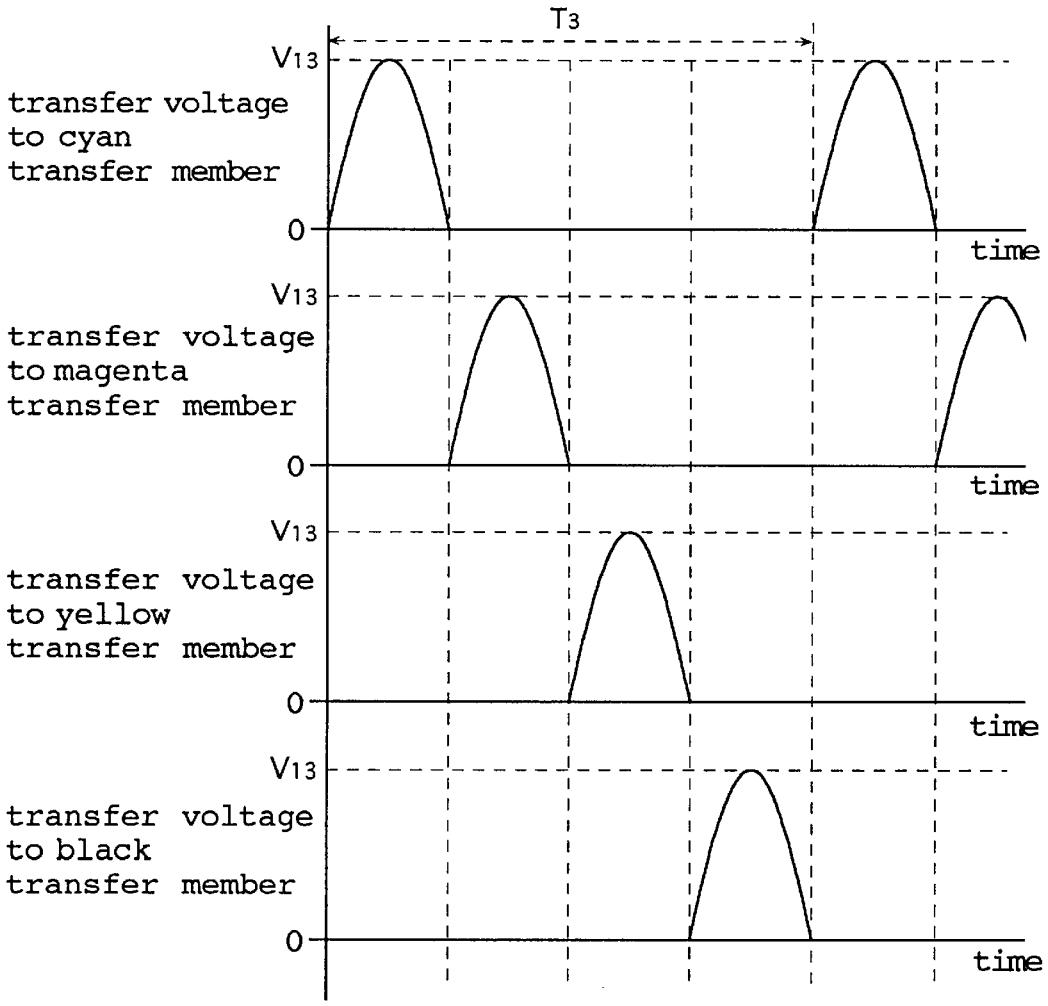
FIG. 5 shows, as still another example, the waveforms of AC voltages applied to respective transfer members of the image forming apparatus shown in FIG. 1 as well as the phase relationships between them.

(5) The AC voltage applied to each transfer member (transfer brush in the image forming apparatus A1) may be, e.g., a half-wave sinusoidal pulse AC voltage shown in FIG. 5 instead of the rectangular pulse AC voltage.

The half-wave sinusoidal pulse AC voltage shown in FIG. 5 has a maximum voltage $V_{13}$, a minimum voltage of 0 volts and a period $T_3$. The voltage $V_{13}$ in this embodiment is equal to +1.5 kilovolts. The successively neighboring four transfer members are supplied with above half-wave sinusoidal pulse AC voltages which are successively shifted by 90°.

Thereby, the two or more transfer members are not simultaneously supplied with the voltage higher, in absolute value, than 0 volts in the transfer operation. Accordingly, interference of the transfer current between the transfer regions can be suppressed so that good transfer of the toner image can be performed.

(6) Only by applying the transfer voltages to the transfer members in such a manner that successively neighboring at least two transfer members are not simultaneously supplied with the voltage, in contrast to the case where the successively neighboring four transfer members are not simultaneously supplied with the voltages as is done in the manner shown in FIGS. 3 and 5, it is possible to suppress transfer failure such as irregular transfer due to interference of the transfer current between the transfer regions.

Also, only by applying the transfer voltages to the transfer members in such a manner that successively neighboring at least two transfer members are not simultaneously supplied with the voltage of the magnitude equal to or larger than that necessary for toner image transfer, the transfer failure such as irregular transfer due to the interference of the transfer current between the transfer regions can be suppressed.

By applying the AC voltages to the respective transfer members, e.g., in the manners described in following items (6-1) and (6-2), the transfer failure can be suppressed than the prior art.

Figure 6:
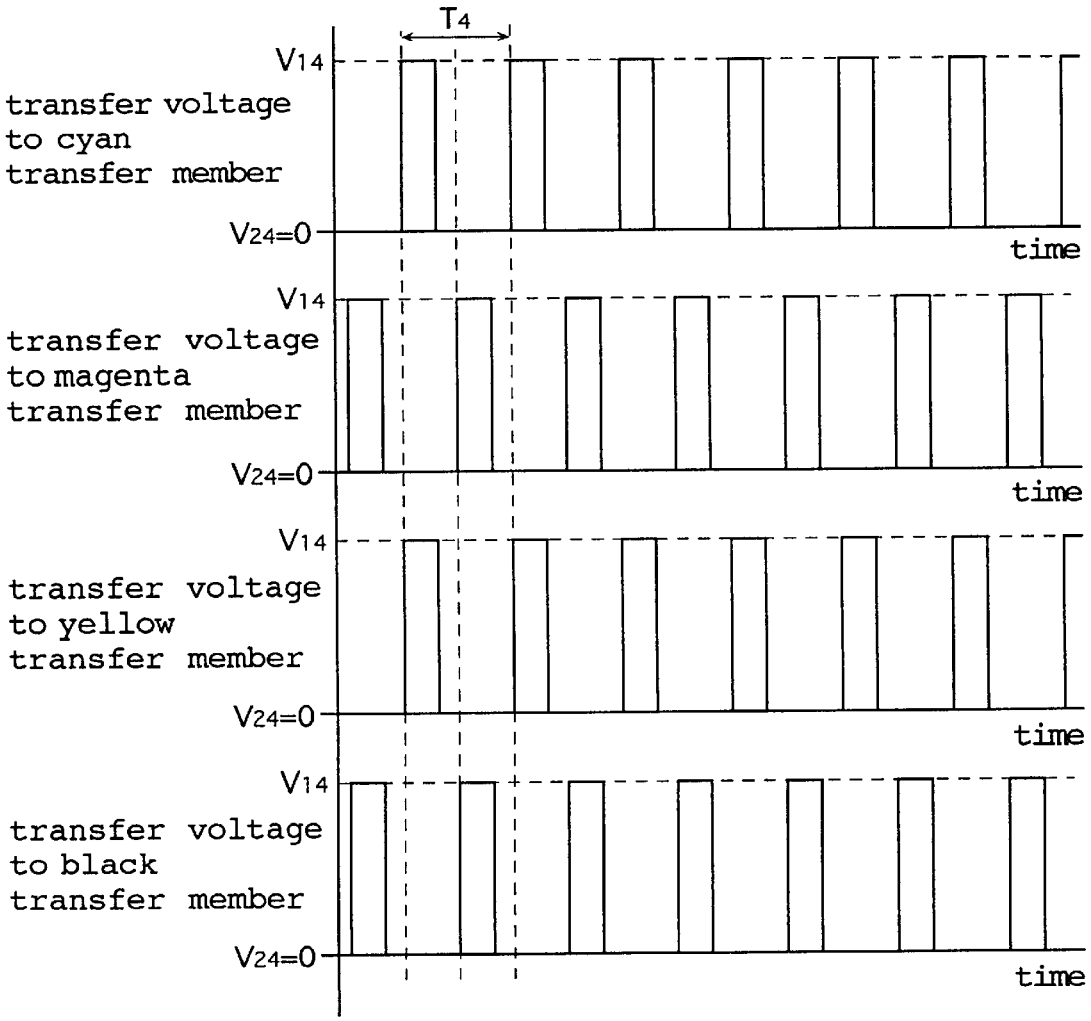
FIG. 6 shows, as yet another example, the waveforms of AC voltages applied to respective transfer members of the image forming apparatus shown in FIG. 1 as well as the phase relationships between them.

(6-1) By applying the rectangular pulse AC voltages shown in FIG. 6 to the respective transfer brushes, the transfer failure such as irregular transfer due to the interference of the transfer current can be suppressed.

The rectangular pulse AC voltage shown in FIG. 6 has a period $T_4$, and in which voltages $V_{14}$ and $V_{24}$ appear alternately. The voltage $V_{14}$ in this embodiment is equal to +1.5 kilovolts. The voltage $V_{24}$ is equal to 0 volts.

The respective transfer brushes are supplied with the above rectangular pulse AC voltages having phases shifted as follows. The cyan and yellow transfer brushes 41C and 41Y are supplied with the rectangular pulse AC voltages of the same phases. The magenta and black transfer brushes 41M and 41K are supplied with the rectangular pulse AC voltages of the same phases. The transfer brushes 41C and 41Y are supplied with the rectangular pulse AC voltages having the phases shifted by 180° from each other.

Thereby, the neighboring two transfer brushes are not simultaneously supplied with the voltage of $V_{14}$ which is higher, in absolute value, than 0 volts. Only by the manner, as described above, in which the neighboring only two transfer brushes are not simultaneously supplied with the voltage, interference of the transfer current and therefore transfer failure such as irregular transfer can be suppressed than the case where all the transfer brushes are simultaneously supplied with the DC voltages, or the case where the neighboring two transfer brushes are supplied with the AC voltages of the same phases.

Since the transfer brushes 41C and 41Y are supplied with the rectangular pulse AC voltages of the same phases, these transfer brushes 41C and 41Y may be connected to a common power source instead of the power sources PSC and PSY, respectively. Likewise, the transfer brushes 41M and 41K are supplied with the rectangular pulse AC voltages of the same phases, and therefore may be connected to a common power source. For example, the structure of an image forming apparatus A2 shown in FIG. 7 may be employed.

Figure 7:
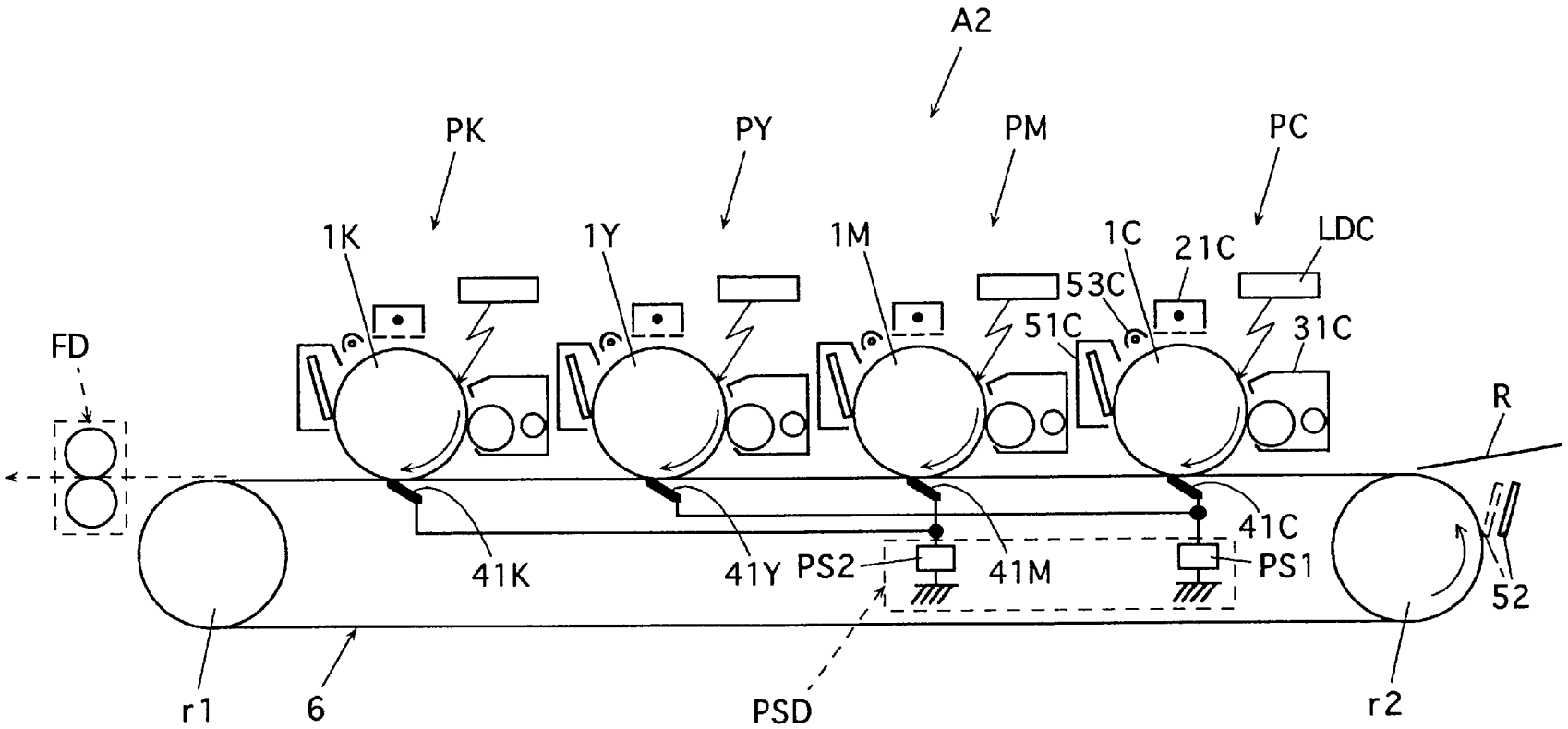
FIG. 7 schematically shows another example of the structure of the image forming apparatus according to the invention.

In the image forming apparatus A2 shown in FIG. 7, the transfer brushes 41C and 41Y are connected to a common power source PS1. The transfer brushes 41M and 41K are connected to a common power source PS2. Since employing the common power source for the two transfer brushes, the transfer power source device PSD can be compact and inexpensive. Thereby, the image forming apparatus can be compact and inexpensive as a whole.

Figure 8:
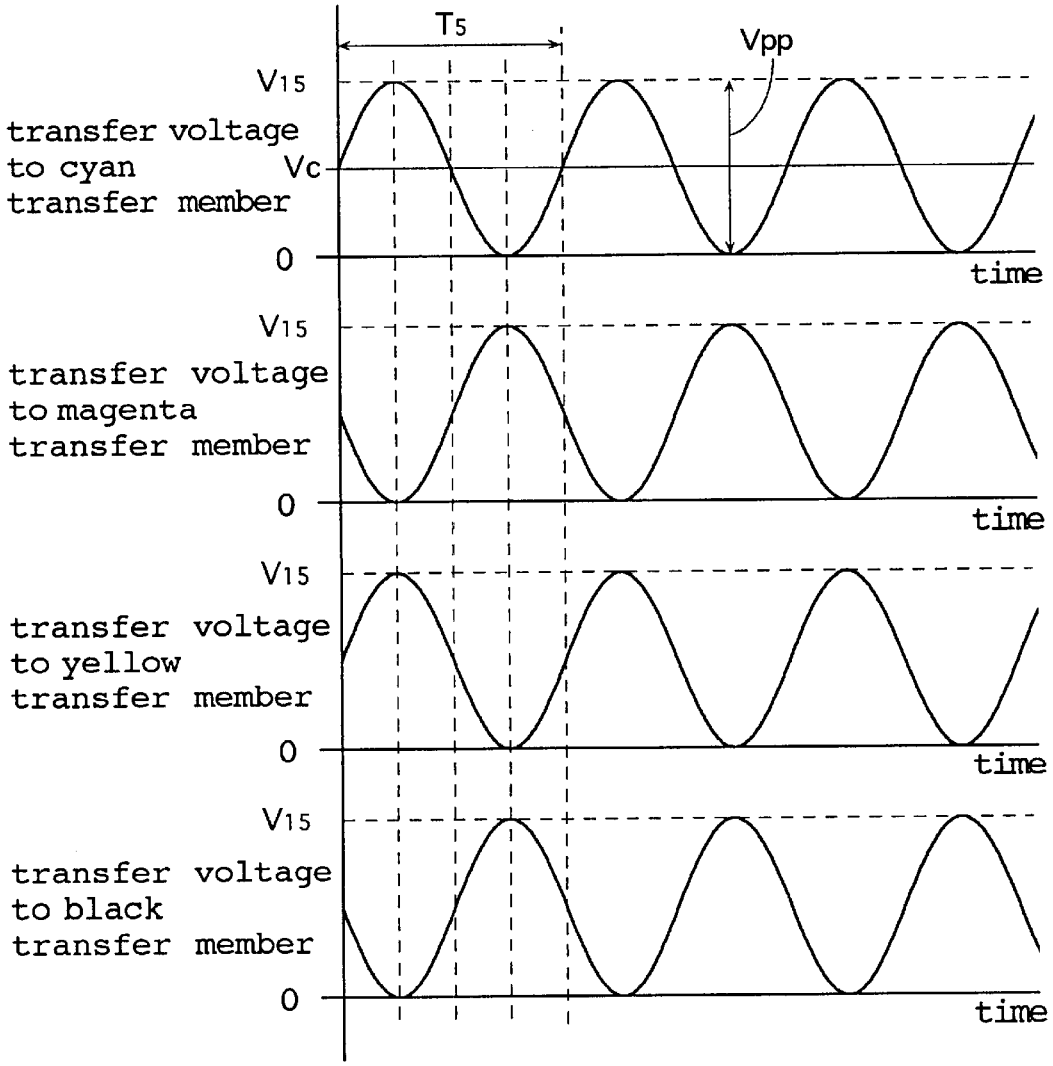
FIG. 8 shows, as further another example, the waveforms of AC voltages applied to respective transfer members of the image forming apparatus shown in FIG. 1 as well as the phase relationships between them.

(6-2) By applying the sinusoidal AC voltages shown in FIG. 8 to the respective transfer brushes, the transfer failure such as irregular transfer due to the interference of the transfer current can be suppressed.

The AC voltage shown in FIG. 8 is a sinusoidal AC voltage having a maximum value $V_{15}$ and a minimum value of 0 volts as well as a period $T_5$. The voltage $V_{15}$ is equal to 1.5 kilovolts in this embodiment. In other words, this sinusoidal AC voltage has a central voltage Vc which is shifted positively by half the peak-to-peak voltage Vpp ($v_{15}/2$) from 0 volts.

The transfer brushes 41C and 41Y are supplied with the sinusoidal AC voltages of the same phases. The transfer brushes 41M and 41K are supplied with the sinusoidal AC voltages of the same phases. The transfer brushes 41C and 41Y are supplied with the sinusoidal AC voltages of the phases shifted by 180° from each other.

Owing to the above, every neighboring two transfer brushes are not simultaneously supplied with the voltages larger than 0.75 kilovolts, i.e., 50% of voltage $V_{15}$. When one of the neighboring two transfer brushes is supplied with a voltage close to the maximum voltage $V_{15}$, the other transfer brush is supplied with a voltage close to the minimum voltage of 0 volts.

Accordingly, the interference of the transfer current and therefore the transfer failure such as irregular transfer can be suppressed than the case where all the transfer brushes are supplied with the sinusoidal AC voltages of the same phases.

Figure 9:
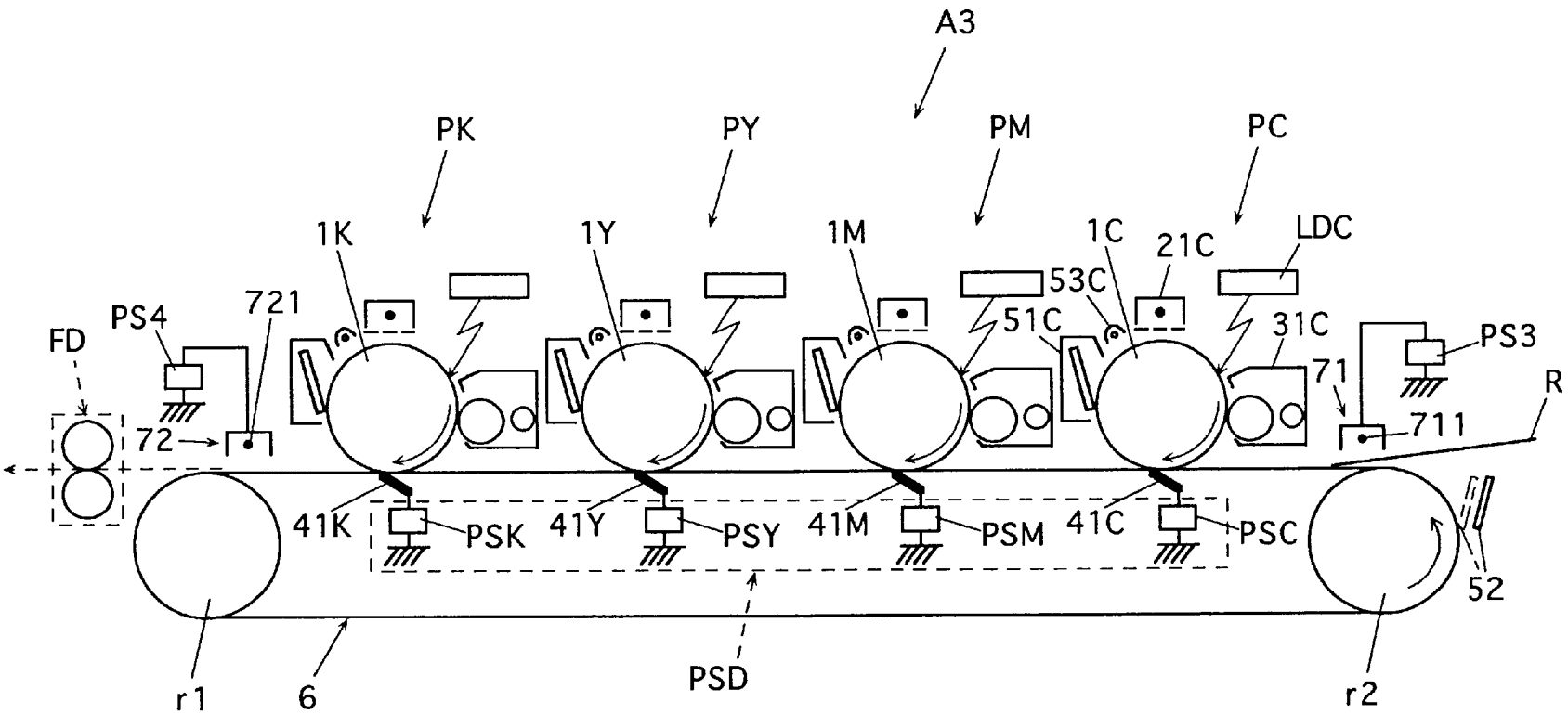
FIG. 9 schematically shows still another example of the structure of the image forming apparatus according to the invention.

(7) FIG. 9 schematically shows another example of the structure of the image forming apparatus according to the invention.

An image forming apparatus A3 shown in FIG. 9 includes the same components as those of the image forming apparatus A1 shown in FIG. 1, and additionally includes an attracting device 71 and a separating device 72 which have the following structures.

The attracting device 71 is provided for electrostatically attracting the record sheet R onto the outer peripheral surface of the sheet transporting belt 6. The attracting device 71 is disposed upstream in the sheet transporting direction to the cyan image forming unit PC. The attracting device 71 is opposed to the sheet transporting belt 6. The attracting device 71 in this embodiment is a so-called corona charger. The attracting device 71 has a discharging electrode 711 of a wire form extending in the axial direction of the photosensitive member. The discharging electrode 711 is connected to a power source PS3. By applying a voltage from power source PS3 to the discharging electrode 711, discharging from the discharging electrode 711 to the sheet transporting belt 6 can be performed. Owing to charges supplied by this discharging, the sheet transporting belt 6 can electrostatically attract the record sheet R.

The separating device 72 is provided for facilitating separation of the record sheet from the sheet transporting belt 6 when the record sheet R attracted on the sheet transporting belt 6 is separated from the belt 6.

The separating device 72 is disposed downstream in the sheet transporting direction from the black image forming unit PK. The separating device 72 is opposed to the sheet transporting belt 6. The separating device 72 in this embodiment is a so-called corona charger. The separating device 72 has a discharging electrode 721. The discharging electrode 721 is connected to a power source PS4. By applying the voltage to the discharging electrode 721, discharging from the discharging electrode 721 to the sheet transporting belt 6 can be performed. The charges supplied by this discharging can function to erase charges on the record sheet which is electrostatically attracted on the sheet transporting belt 6. This enables easy separation of the record sheet from the sheet transporting belt 6, and the record sheet can be separated from the sheet transporting belt 6 owing to the curved surface of the belt defined by the roller r1 as well as the elasticity of the record sheet itself.

In the image forming apparatus A3, the discharging current flowing from the attracting device 71 and/or the discharging current flowing from the separating device 72 may interfere with the transfer currents flowing from the respective transfer members, and thereby transfer failure such as irregular transfer may occur. For preventing this, the application of the voltages, to the discharging electrodes 711 and 721 of the attracting device 71 and the separating device 72 as well as the transfer brushes, is controlled as follows.

Figure 10:
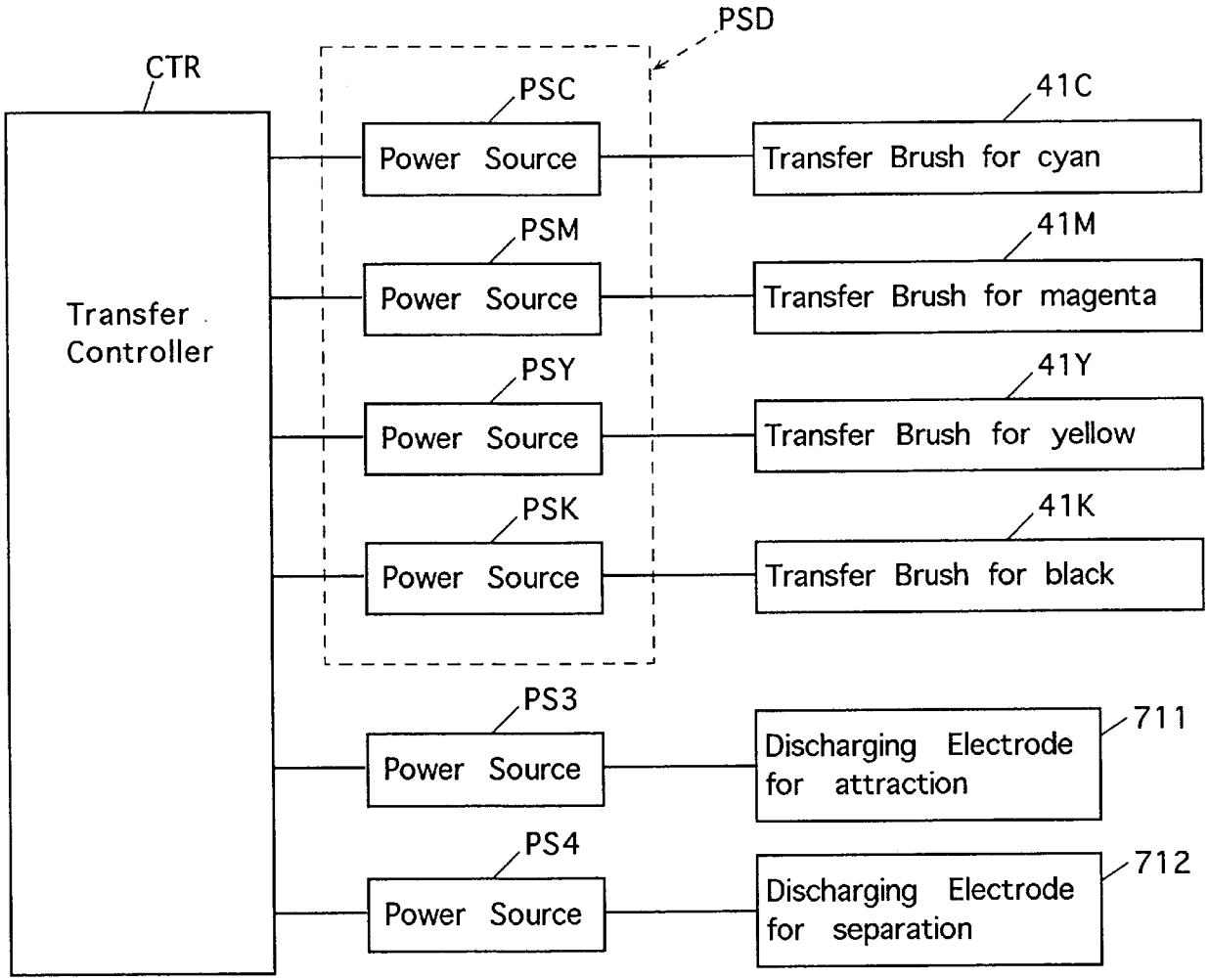
FIG. 10 is a schematic block diagram of devices related to transfer of toner images in the image forming apparatus shown in FIG. 9.
Figure 11:
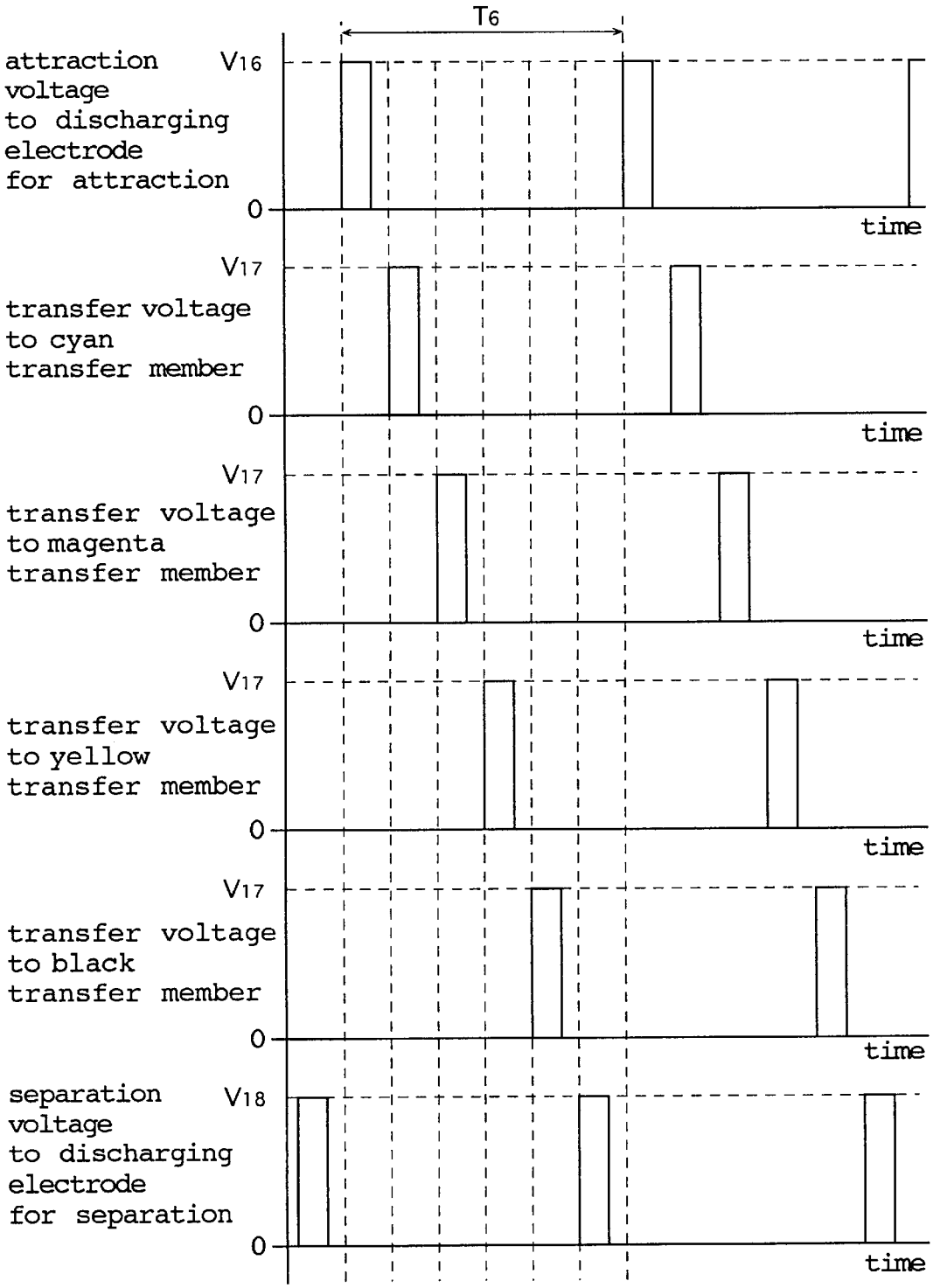
FIG. 11 shows an example of waveforms of AC voltages applied to respective transfer members, a discharging electrode for attraction and a discharging electrode for separation of the image forming apparatus shown in FIG. 1 as well as the phase relationships between them.

The power sources which are connected to the discharging electrodes and the transfer brushes, respectively, are connected to the transfer controller CTR as shown in FIG. 10. The transfer controller CTR controls application of the voltages to the discharging electrodes and the transfer brushes. These discharging electrodes and the transfer brushes are supplied with the AC voltages as shown in FIG. 11.

The discharging electrode 711 for attraction is supplied with a rectangular pulse AC voltage of a period $T_6$ in which a voltage $V_{16}$ and a voltage of 0 volts appear alternately.

Each of the transfer brushes 41C, 41M, 41Y and 41K is supplied with a rectangular pulse AC voltage of the period of $T_6$ in which a voltage $V_{17}$ and a voltage of 0 volts appear alternately.

The discharging electrode 721 for separation is supplied with a rectangular pulse AC voltage of a period of $T_6$, in which a voltage $V_1$ and a voltage of 0 volts appear alternately.

The discharging electrode 711 for attraction, the transfer brushes 41C, 41M, 41Y and 41K, and discharging electrode 721 for separation are supplied with rectangular pulse AC voltages of the phases which are shifted successively in this order by 60°.

Thereby, the transfer voltages are not simultaneously applied to the two or more transfer brushes. The discharging electrode 711 for attraction and any one of the transfer brushes are not simultaneously supplied with the voltages. Further, the discharging electrode 721 for separation and any one of the transfer brushes are not simultaneously supplied with the voltages.

Accordingly, the interference of the transfer current between the transfer regions can be suppressed. The interference between the attraction discharging current flowing from the attraction discharging electrode 711 and the transfer current can be suppressed. The interference between the separation discharging current flowing from the separation discharging electrode 721 and the transfer current can be suppressed. Owing to these features, the transfer failure such as irregular transfer can be suppressed also in the image forming apparatus A3, and good transfer of the toner images can be performed.

(8) The record sheet may be transported successively to the positions opposed to the respective photosensitive members in the following manner instead of by the sheet transporting belt as is done in the image forming apparatus shown in FIG. 1

Figure 12:
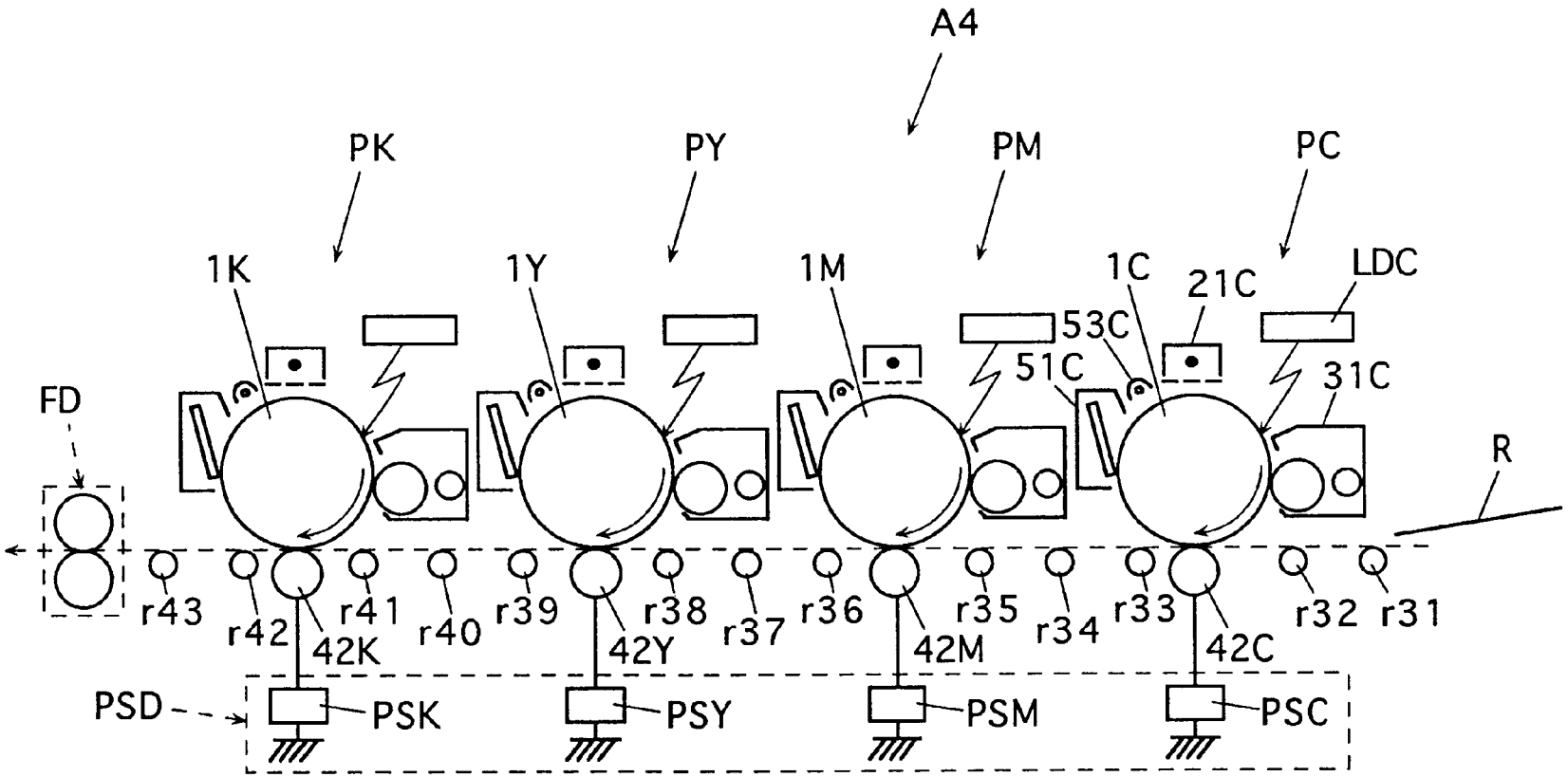
FIG. 12 schematically shows still another example of the structure of the image forming apparatus according to the invention.

For example, the structure of an image forming apparatus A4 shown in FIG. 12 may be employed.

In the image forming apparatus A4, 13 rollers r31–r43 for transporting the record sheet are disposed under the sheet transporting path depicted by dotted line in FIG. 12. Drive devices (not shown) can drive the sheet transporting rollers r31–r43 to rotate counterclockwise in FIG. 12, respectively. By rotating the sheet transfer rollers, the record sheet is transported successively to the positions opposed to the respective photosensitive members.

In the image forming apparatus A4, a transfer roller is employed as the transfer member to which the transfer voltage is applied, instead of the transfer brush. The photosensitive members 1C, 1M, 1Y and 1K are in contact with the transfer rollers 42C, 42M, 42Y and 42K, respectively. The transfer failure in the transfer regions can be suppressed by applying the AC voltages to the respective transfer rollers similarly to the manner of applying the AC voltages to the transfer brushes as described above.

The transfer member may be a transfer blade or a transfer sheet instead of the transfer brush and the transfer roller. The transfer member may be a discharging electrode of a discharging charger such as a corona charger or a Scorotron charger.

Figure 13:
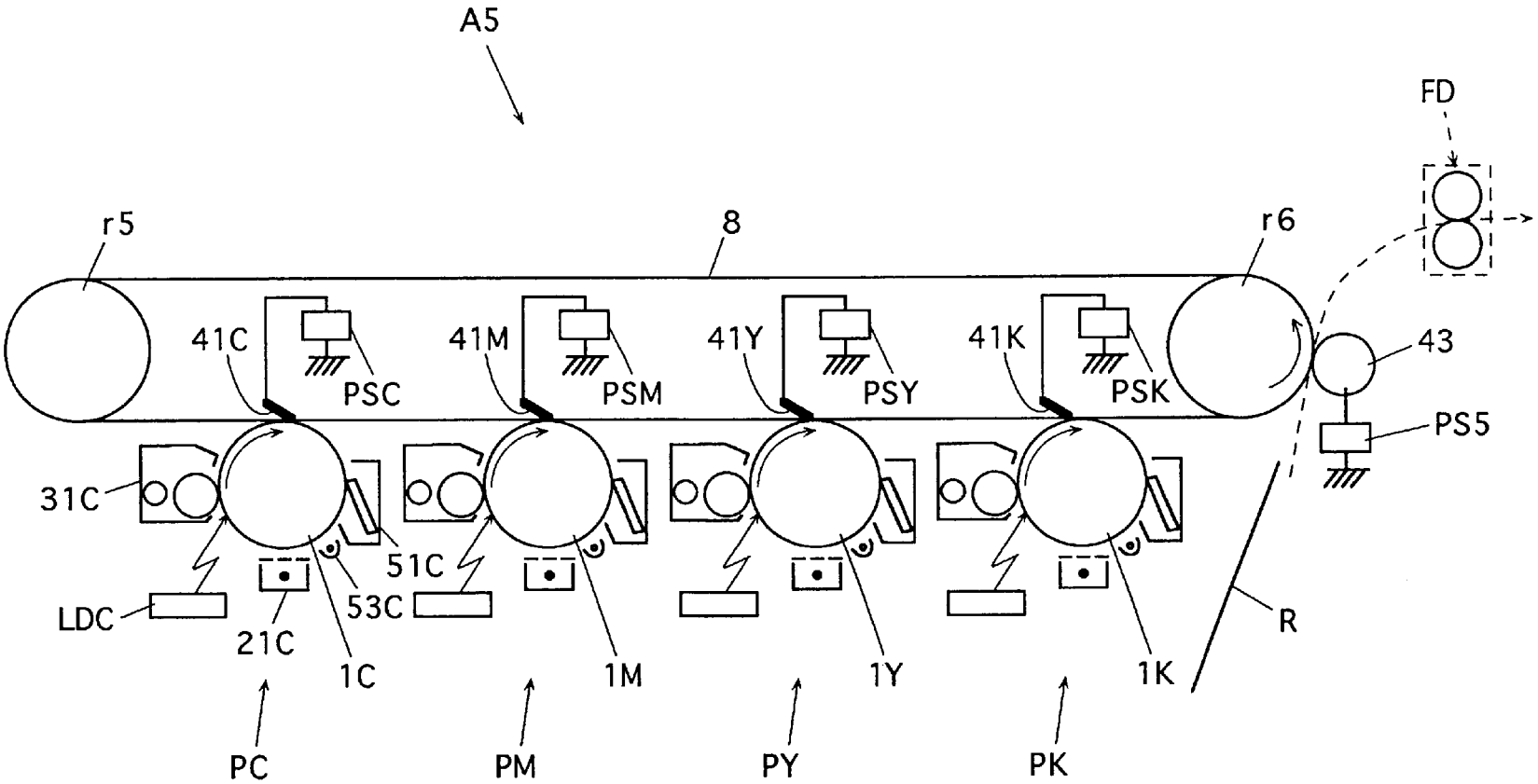
FIG. 13 schematically shows further another example of the structure of the image forming apparatus according to the invention.

(9) FIG. 13 schematically shows a structure of still another example of the image forming apparatus according to the invention.

An image forming apparatus A5 shown in FIG. 13 has the four image forming units PC, PM, PY and PK, similarly to the image forming apparatus A1. In the image forming units, the toner images are formed on the photosensitive members 1C, 1M, 1Y and 1K, respectively. An intermediate transfer belt 8 is opposed to the respective photosensitive members. The intermediate transfer belt 8 is an endless belt retained around two rollers r5 and r6.

For transferring the toner images formed on the respective photosensitive members onto the intermediate transfer belt 8, transfer brushes 41C, 41M, 41Y and 41K are disposed at the positions opposed to the photosensitive members 1C, 1M, 1Y and 1K, respectively. Each transfer brush is disposed inside the intermediate transfer belt 8. The power sources PSC, PSM, PSY and PSK are connected to transfer brushes 41C, 41M, 41Y and 41K, respectively.

A secondary transfer roller 43 is opposed to the intermediate transfer belt 8. The secondary transfer roller 43 is in contact with a portion of the intermediate transfer belt 8, which is wound around the roller r6. The secondary transfer roller 43 is connected to a power source PS5.

In the image forming apparatus A5, the toner images formed on the respective photosensitive members are not transferred directly onto the record sheet, but are temporarily transferred onto the intermediate transfer belt 8. The toner images formed on the respective photosensitive members are electrostatically transferred onto the intermediate transfer belt 8 by applying the transfer voltages to the respective transfer brushes. The toner images on the intermediate transfer belt 8 are collectively transferred onto the record sheet R, which is to be moved through a position between the intermediate transfer belt 8 and the secondary transfer roller 43, by applying the transfer voltage to the secondary transfer roller 43. The record sheet carrying the toner image thus transferred is discharged from the apparatus after fixing the toner image by the fixing device FD.

Figure 14:
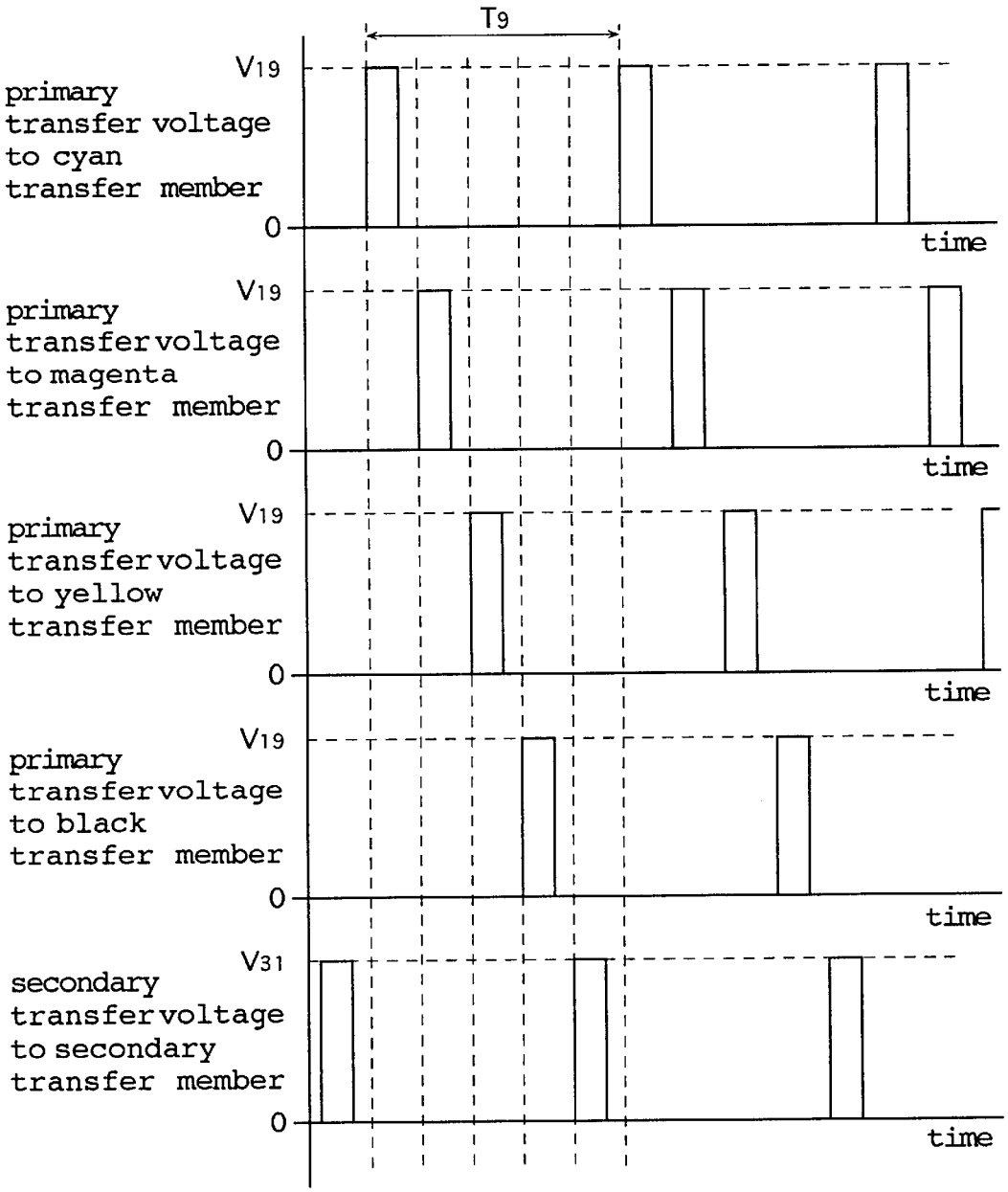
FIG. 14 shows an example of waveforms of AC voltages applied to respective transfer members and second transfer members of the image forming apparatus shown in FIG. 13 as well as the phase relationships between them.

The respective transfer brushes for the primary transfer and the transfer roller 43 for the secondary transfer are supplied with the AC voltages shown in FIG. 14.

Each of the primary transfer brushes 41C, 41M, 41Y and 41K is supplied with a rectangular pulse AC voltage of a period $T_9$, in which a voltage $V_{19}$ and a voltage of 0 volts alternately appear.

The secondary transfer roller 43 is supplied with a rectangular pulse AC voltage of the period $T_9$, in which a voltage $V_{31}$ and a voltage of 0 volts alternately appear.

The primary transfer brushes 41C, 41M, 41Y and 41K as well as the secondary transfer roller 43 are supplied with the rectangular pulse AC voltages of the phases which are shifted successively in this order by 72°.

Owing to the above manner of application of the voltages, the two or more primary transfer brushes are not simultaneously supplied with the voltages. Further, the secondary transfer roller 43 and any one of the first transfer brushes are not simultaneously supplied with the voltages.

Accordingly, the interference of the transfer currents between the primary transfer regions can be suppressed. Also, the interference of the secondary transfer current flowing from the secondary transfer roller 43 with the primary transfer current can be suppressed. Accordingly, also in the image forming apparatus A5, it is possible to suppress the transfer failure such as irregular transfer in the primary transfer (i.e., transfer from the photosensitive member to the intermediate transfer belt 8) as well as the secondary transfer (i.e., transfer from the intermediate transfer belt 8 to the record sheet). In a result, a good color toner image can be formed on the record sheet.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A transfer voltage applying method in an image forming apparatus for transferring toner images formed respectively on a plurality of image carriers onto an image transfer target member to be moved successively through positions where a plurality of transfer members are respectively opposed to said image carriers by respectively applying transfer voltages to said plurality of transfer members, comprising:

respectively supplying said plurality of transfer members with AC voltages as said transfer voltages so that successively neighboring at least two transfer members are respectively supplied with AC voltages having phases shifted from each other and said successively neighboring at least two transfer members are not simultaneously supplied with voltages that are each a maximum, in absolute value, of each AC voltage.

2. The transfer voltage applying method according to claim 1, wherein said successively neighboring at least two transfer members are not simultaneously supplied with the voltage each, in absolute value, larger than 80% of the maximum, in absolute value, of each AC voltage.

3. The transfer voltage applying method according to claim 1, wherein the AC voltages supplied to said transfer members are of the same period and the same waveform.

4. The transfer voltage applying method according to claim 1, wherein each transfer member is supplied with a rectangular pulse AC voltage of a predetermined period in which a voltage $V_1$ and a voltage $V_2$, satisfying a relationship of $V_1 \cdot V_2 \geqq 0$ and a relationship of $|V_1|<|V_2|$, appear alternately;

said successively neighboring at least two transfer members are supplied with rectangular pulse AC voltages having phases shifted from each other, respectively; and said successively neighboring at least two transfer members are not simultaneously supplied with said voltage $V_1$.

5. The transfer voltage applying method according to claim 4, wherein said voltage $V_2$ is equal to 0 volts.

6. The transfer voltage applying method according to claim 4, wherein the absolute value $|V_2|$ of said voltage $V_2$ is 80% or less of the absolute value $|V_1|$ of said voltage $V_1$.

7. The transfer voltage applying method according to claim 1, wherein each transfer member is supplied with a sinusoidal AC voltage of a predetermined period having a central voltage shifted from 0 volts by ½ or more of a peak-to-peak voltage; and said successively neighboring at least two transfer members are supplied with said sinusoidal AC voltages having phases shifted by 180° from each other.

8. The transfer voltage applying method according to claim 7, wherein the minimum voltage, in absolute value, of said sinusoidal AC voltage is equal to 0 volts.

9. The transfer voltage applying method according to claim 1, wherein a period of each AC voltage applied to a respective transfer member is equal to or shorter than a time required for moving one point on said image transfer target member through a transfer region where said respective transfer member is opposed to a corresponding image carrier.

10. The transfer voltage applying method according to claim 1, wherein said transfer members are in contact with said image carriers, respectively;

a nip portion between each transfer member and a corresponding image carrier has a width of W (mm);

said image transfer target member moves at a surface of speed of V(mm/sec) through each nip portion; and a period T (sec) of each of said AC voltages applied to each transfer member satisfies a relationship of $T \leqq W/V$.

11. An image forming apparatus for forming a toner image based on an original image on a record sheet, comprising:

a plurality of image carriers;

a plurality of image forming devices respectively provided for said plurality of image carriers and each provided for forming a toner image on a corresponding image carrier;

a plurality of transfer devices respectively provided for said plurality of image carriers each including a transfer member opposed to a corresponding image carrier, and each provided for transferring the toner image on said corresponding image carrier onto an image transfer target member to be moved successively through positions between each of said plurality of image carriers and corresponding transfer members by applying a transfer voltage to a respective transfer member; and a transfer power source device for applying AC voltages as said transfer voltages respectively to said transfer members; wherein said transfer power source device supplies AC voltages having phases shifted from each other to successively neighboring at least two transfer members, respectively, so as that said successively neighboring at least two transfer members are not simultaneously supplied with voltages that are each a maximum in absolute value, of each AC voltages.

12. The image forming apparatus according to claim 11, wherein said successively neighboring at least two transfer members are not simultaneously supplied from said transfer power source device with the voltages each in absolute value larger than 80% of the maximum, in absolute value, of each AC voltage.

13. The image forming apparatus according to claim 11, wherein the AC voltages supplied from said transfer power source device to said transfer members are of the same period and the same waveform.

14. The image forming apparatus according to claim 11, wherein each transfer member is supplied from said transfer power source device with a rectangular pulse AC voltage of a predetermined period in which a voltage $V_1$ and a voltage $V_2$ satisfying a relationship of $V_1 \cdot V_2 \geqq 0$ and a relationship of $|V_1| > |V_2|$, appear alternately;

said successively neighboring at least two transfer members are supplied from said transfer power source device with rectangular pulse AC voltages having phases shifted from each other, respectively; and said successively neighboring at least two transfer members are not simultaneously supplied with said voltage $V_1$.

15. The image forming apparatus according to claim 14, wherein said voltage $V_2$ is equal to 0 volts.

16. The image forming apparatus according to claim 14, wherein the absolute value $|V_2|$ of said voltage $V_2$ is 80% or less of the absolute value $|_1|$ of said voltage $V_1$.

17. The image forming apparatus according to claim 11, wherein each transfer member is supplied from said transfer power source device with a sinusoidal AC voltage of a predetermined period having a central voltage shifted from 0 volts by ½ or more of a peak-to-peak voltage, and said two transfer members neighboring to each other are supplied with said sinusoidal AC voltages having phases shifted by 180° from each other.

18. The image forming apparatus according to claim 17, wherein the minimum voltage, in absolute value, of said sinusoidal AC voltage is equal to 0 volts.

19. The image forming apparatus according to claim 11, wherein a period of each AC voltage applied to a respective transfer member is equal to or shorter than a time required for moving one point on said image transfer target member through a transfer region where said respective transfer member is opposed to a corresponding image carrier.

20. The image forming apparatus according to claim 11, wherein said transfer members are in contact with said image carriers, respectively;

a nip portion between each transfer member and a corresponding image carrier has a width of W (mm);

said image transfer target member moves at a surface of speed of V (mm/sec) through each nip portion; and a period T (sec) of each of said AC voltages applied to each transfer member satisfies a relationship of $T \leqq W/V$.

21. The image forming apparatus according to claim 11, wherein each transfer member is a brush, a roller, a blade or a sheet.

22. The image forming apparatus according to claim 11, wherein each transfer device is a discharging charger for performing discharging toward said image transfer target member, and each transfer member includes a discharging electrode.

23. The image forming apparatus according to claim 11, wherein said image transfer target member is a record sheet.

24. The image forming apparatus according to claim 23, further comprising:

a sheet transporting device for successively transporting said record sheet to the positions opposed to the respective image carriers.

25. The image forming apparatus according to claim 24, wherein said sheet transporting device includes a sheet transporting rotary member having an outer peripheral surface opposed to all the image carriers, and each transfer member is opposed to a corresponding image carrier with said sheet transporting rotary member therebetween.

26. The image forming apparatus according to claim 25, further comprising:

an attracting device including an attracting member opposed to said sheet transporting rotary member for attracting said record sheet, to be moved through a position between said attracting member and said sheet transporting rotary member, onto the outer peripheral surface of said sheet transporting rotary member by applying an attraction voltage to said attracting member; and an attraction power source for applying a predetermined attraction AC voltage to said attracting member; wherein said transfer power source device does not apply a voltage that is a maximum, in absolute value, of an AC voltage to a transfer member neighboring to said attracting member when said attraction power source applies a voltage that is a maximum, in absolute value, of said attraction AC voltage to said attracting member.

27. The image forming apparatus according to claim 26, wherein said transfer power source device does not apply the voltage in absolute value larger than 80% of the maximum voltage, in absolute value, of said AC voltage to said transfer member neighboring to said attracting member when said attraction power source applies the voltage in absolute value larger than 80% of the maximum voltage, in absolute value, of said attraction AC voltage to said attracting member.

28. The image forming apparatus according to claim 25, further comprising:

a separating device including a separating member opposed to said sheet transporting rotary member for separating said record sheet from said sheet transporting rotary member by applying a separation voltage to said separating member; and a separation power source for applying a predetermined separation AC voltage to said separating member; wherein said transfer power source device does not apply the maximum voltage, in absolute value, of said AC voltage to said transfer member neighboring to said separating member when said separation power source applies the maximum voltage, in absolute value, of said separation AC voltage to said separating member.

29. The image forming apparatus according to claim 28, wherein said transfer power source device does not apply the voltage in absolute value larger than 80% of the maximum voltage, in absolute value, of said AC voltage to said transfer member neighboring to said separating member when said separation power source applies the voltage in absolute value larger than 80% of the maximum voltage, in absolute value, of said separation AC voltage to said separating member.

30. The image forming apparatus according to claim 11, wherein said image transfer target member is an intermediate transfer member for temporarily holding the toner image to be transferred onto the record sheet.

31. The image forming apparatus according to claim 30, further comprising:

a secondary transfer device including a secondary transfer member opposed to said intermediate transfer member for transferring the toner image on said intermediate transfer member onto the record sheet to be moved through a position between said intermediate transfer member and said secondary transfer member by applying a secondary transfer voltage to said secondary transfer member; and a secondary transfer power source for applying a predetermined secondary transfer AC voltage to said secondary transfer member; wherein said transfer power source device does not apply the maximum voltage, in absolute value, of said AC voltage to said transfer member neighboring to said secondary transfer member when said secondary transfer power source applies the maximum voltage, in absolute value, of said secondary transfer AC voltage to said secondary transfer member.

32. The image forming apparatus according to claim 31, wherein said transfer power source device does not apply the voltage in absolute value larger than 80% of the maximum voltage, in absolute value, of said AC voltage to said transfer member neighboring to said secondary transfer member when said secondary transfer power source applies the voltage in absolute value larger than 80% of the maximum voltage, in absolute value, of said secondary transfer AC voltage to said secondary transfer member.

* * * * *